US008717124B2

(12) United States Patent
Vanhille et al.

(10) Patent No.: US 8,717,124 B2
(45) Date of Patent: May 6, 2014

(54) THERMAL MANAGEMENT

(75) Inventors: Kenneth Vanhille, Blacksburg, VA (US); David Sherrer, Radford, VA (US)

(73) Assignee: Nuvotronics, LLC, Radford, VA (US)

( * ) Notice: Subject to any disclaimer, the term of this patent is extended or adjusted under 35 U.S.C. 154(b) by 445 days.

(21) Appl. No.: 13/011,889

(22) Filed: Jan. 22, 2011

(65) Prior Publication Data

US 2011/0181377 A1 Jul. 28, 2011

Related U.S. Application Data

(60) Provisional application No. 61/297,715, filed on Jan. 22, 2010.

(51) Int. Cl.
*H01P 3/06* (2006.01)
*H01P 1/00* (2006.01)

(52) U.S. Cl.
USPC ..... 333/244; 333/245

(58) Field of Classification Search
USPC ..... 333/236, 239, 243, 244, 245, 248
See application file for complete search history.

(56) References Cited

U.S. PATENT DOCUMENTS

| | | | |
|---|---|---|---|
| 2,812,501 | A | 11/1957 | Sommers |
| 2,914,766 | A | 11/1959 | Butler |
| 2,997,519 | A | 8/1961 | Hines et al. |
| 3,309,632 | A | 3/1967 | Trudeau |
| 3,311,966 | A | 4/1967 | Henry |
| 3,335,489 | A | 8/1967 | Grant |
| 3,352,730 | A | 11/1967 | Murch |
| 3,464,855 | A | 9/1969 | Quintana |
| 3,560,896 | A | 2/1971 | Essinger |
| 3,760,306 | A | 9/1973 | Spinner et al. |
| 3,775,844 | A | 12/1973 | Parks |
| 3,789,129 | A | 1/1974 | Ditscheid |
| 3,791,858 | A | 2/1974 | McPherson |
| 3,963,999 | A | 6/1976 | Nakajima |
| 4,021,789 | A | 5/1977 | Furman |

(Continued)

FOREIGN PATENT DOCUMENTS

| | | |
|---|---|---|
| CA | 2055116 | 5/1992 |
| DE | 3623093 | 1/1988 |

(Continued)

OTHER PUBLICATIONS

International Preliminary Report on Patentability dated Jul. 24, 2012 for corresponding PCT/US2011/022173.

(Continued)

*Primary Examiner* — Dean O Takaoka
(74) *Attorney, Agent, or Firm* — Niels Haun; Dann Dorfman Herrell & Skillman, PC

(57) ABSTRACT

A transmission line structure, a transmission line thermal manager and/or process thereof. A transmission line thermal manager may include a thermal member. A thermal member may be configured to form a thermal path, for example away from one or more inner conductors of a transmission line. A part of a thermal member may be formed of an electrically insulative and thermally conductive material. One or more inner conductors may be spaced apart from one or more outer conductors in a transmission line. A transmission line and/or a transmission line thermal manager may be configured to maximize a signal through a system, for example by modifying the geometry of one or more transmission line conductors and/or of a thermal manager.

20 Claims, 17 Drawing Sheets

(56) References Cited

U.S. PATENT DOCUMENTS

Figure 1:
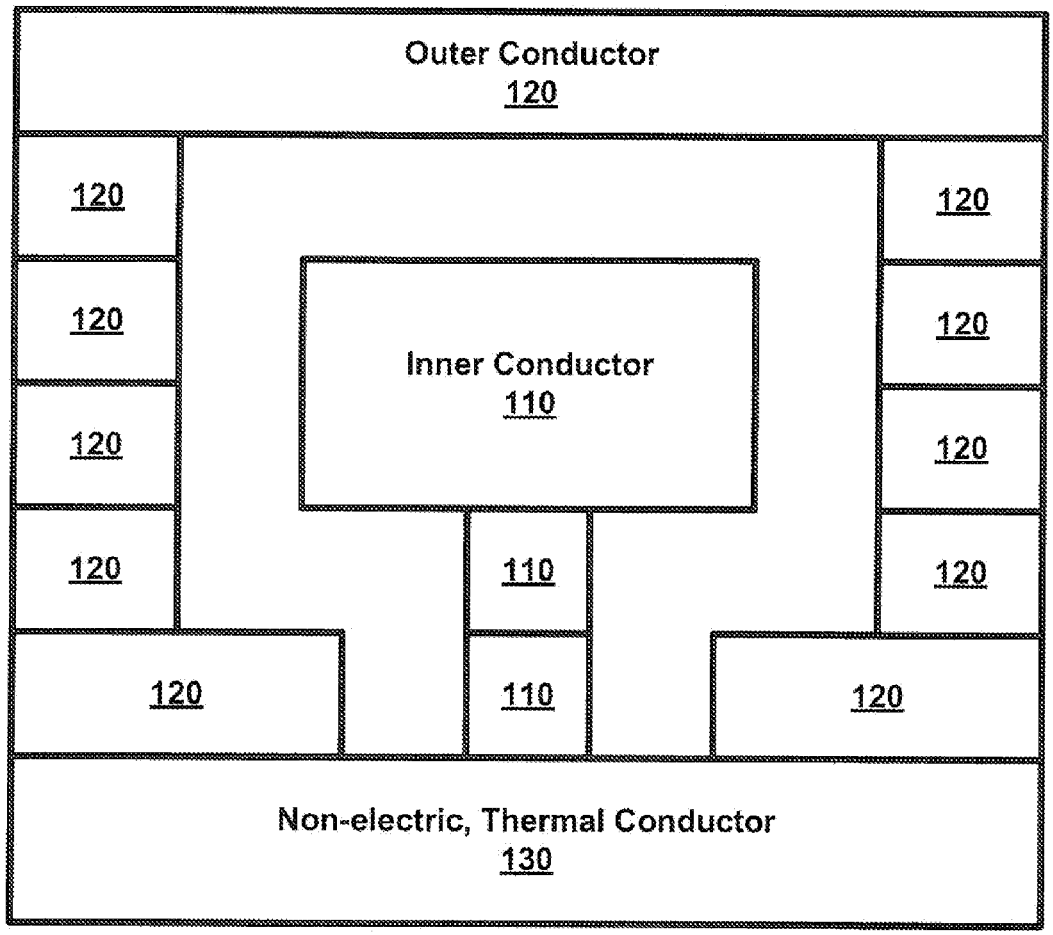

| | | | |
|---|---|---|---|
| 4,075,757 | A | 2/1978 | Malm |
| 4,275,944 | A | 6/1981 | Sochor |
| 4,348,253 | A | 9/1982 | Subbarao |
| 4,365,222 | A | 12/1982 | Lampert |
| 4,414,424 | A | 11/1983 | Mizoguchi et al. |
| 4,417,393 | A | 11/1983 | Becker |
| 4,437,074 | A | 3/1984 | Cohen et al. |
| 4,521,755 | A | 6/1985 | Carlson et al. |
| 4,581,301 | A | 4/1986 | Michaelson |
| 4,591,411 | A | 5/1986 | Reimann |
| 4,641,140 | A | 2/1987 | Heckaman |
| 4,663,497 | A | 5/1987 | Reimann |
| 4,673,904 | A | 6/1987 | Landis |
| 4,700,159 | A | 10/1987 | Jones, III |
| 4,771,294 | A | 9/1988 | Wasilousky |
| 4,808,273 | A | 2/1989 | Hua |
| 4,853,656 | A | 8/1989 | Guillou |
| 4,856,184 | A | 8/1989 | Doeling |
| 4,857,418 | A | 8/1989 | Schuetz |
| 4,876,322 | A | 10/1989 | Budde et al. |
| 4,880,684 | A | 11/1989 | Boss |
| 4,969,979 | A | 11/1990 | Appelt et al. |
| 4,975,142 | A | 12/1990 | Iannacone |
| 5,069,749 | A | 12/1991 | Gutierrez |
| 5,072,201 | A | 12/1991 | Devaux et al. |
| 5,100,501 | A | 3/1992 | Blumenthal |
| 5,119,049 | A | 6/1992 | Heller |
| 5,227,013 | A | 7/1993 | Kumar |
| 5,334,956 | A | 8/1994 | Leding et al. |
| 5,381,157 | A | 1/1995 | Shiga |
| 5,406,235 | A | 4/1995 | Hayashi et al. |
| 5,406,423 | A | 4/1995 | Hayashi |
| 5,430,257 | A | 7/1995 | Lau et al. |
| 5,454,161 | A | 10/1995 | Beilin et al. |
| 5,622,895 | A | 4/1997 | Frank |
| 5,633,615 | A | 5/1997 | Quan |
| 5,682,062 | A | 10/1997 | Gaul |
| 5,682,124 | A | 10/1997 | Suski |
| 5,712,607 | A | 1/1998 | Dittmer |
| 5,724,012 | A | 3/1998 | Teunisse |
| 5,746,868 | A | 5/1998 | Abe |
| 5,793,272 | A | 8/1998 | Burghartz et al. |
| 5,814,889 | A | 9/1998 | Gaul |
| 5,860,812 | A | 1/1999 | Gugliotti |
| 5,872,399 | A | 2/1999 | Lee |
| 5,925,206 | A | 7/1999 | Boyko |
| 5,961,347 | A | 10/1999 | Hsu |
| 5,977,842 | A | 11/1999 | Brown |
| 5,990,768 | A | 11/1999 | Takahashi et al. |
| 6,008,102 | A | 12/1999 | Alford et al. |
| 6,027,630 | A | 2/2000 | Cohen |
| 6,054,252 | A | 4/2000 | Lundy et al. |
| 6,180,261 | B1 | 1/2001 | Inoue et al. |
| 6,210,221 | B1 | 4/2001 | Maury |
| 6,228,466 | B1 | 5/2001 | Tsukada |
| 6,294,965 | B1 | 9/2001 | Merrill et al. |
| 6,350,633 | B1 | 2/2002 | Lin |
| 6,388,198 | B1 | 5/2002 | Bertin |
| 6,457,979 | B1 | 10/2002 | Dove et al. |
| 6,465,747 | B2 | 10/2002 | DiStefano |
| 6,466,112 | B1 | 10/2002 | Kwon et al. |
| 6,514,845 | B1 | 2/2003 | Eng |
| 6,518,165 | B1 | 2/2003 | Yoon |
| 6,535,088 | B1 | 3/2003 | Sherman et al. |
| 6,589,594 | B1 | 7/2003 | Hembree |
| 6,600,395 | B1 | 7/2003 | Handforth et al. |
| 6,603,376 | B1 | 8/2003 | Handforth et al. |
| 6,648,653 | B2 | 11/2003 | Huang |
| 6,662,443 | B2 | 12/2003 | Chou |
| 6,677,248 | B2 | 1/2004 | Kwon |
| 6,749,737 | B2 | 6/2004 | Cheng |
| 6,800,360 | B2 | 10/2004 | Miyanaga |
| 6,800,555 | B2 | 10/2004 | Test |
| 6,827,608 | B2 | 12/2004 | Hall |
| 6,850,084 | B2 | 2/2005 | Hembree |
| 6,888,427 | B2 | 5/2005 | Sinsheimer et al. |
| 6,943,452 | B2 | 9/2005 | Bertin |
| 6,971,913 | B1 | 12/2005 | Chu |
| 6,981,414 | B2 | 1/2006 | Knowles et al. |
| 7,005,750 | B2 | 2/2006 | Liu |
| 7,012,489 | B2 | 3/2006 | Sherrer et al. |
| 7,064,449 | B2 | 6/2006 | Lin |
| 7,077,697 | B2 | 7/2006 | Kooiman |
| D530,674 | S | 10/2006 | Ko |
| 7,129,163 | B2 | 10/2006 | Sherrer |
| 7,148,141 | B2 | 12/2006 | Shim et al. |
| 7,148,772 | B2 | 12/2006 | Sherrer |
| 7,165,974 | B2 | 1/2007 | Kooiman |
| 7,217,156 | B2 | 5/2007 | Wang |
| 7,222,420 | B2 | 5/2007 | Moriizumi |
| 7,239,219 | B2 | 7/2007 | Brown et al. |
| 7,252,861 | B2 | 8/2007 | Smalley |
| 7,259,640 | B2 | 8/2007 | Brown et al. |
| 7,400,222 | B2 | 7/2008 | Kwon et al. |
| 7,405,638 | B2 | 7/2008 | Sherrer et al. |
| 7,449,784 | B2 | 11/2008 | Sherrer et al. |
| 7,478,475 | B2 | 1/2009 | Hall |
| 7,508,065 | B2 | 3/2009 | Sherrer et al. |
| 7,575,474 | B1 | 8/2009 | Dodson |
| 7,579,553 | B2 | 8/2009 | Moriizumi |
| 7,602,059 | B2 | 10/2009 | Nobutaka |
| 7,649,432 | B2 | 1/2010 | Sherrer et al. |
| 7,656,256 | B2 | 2/2010 | Houck et al. |
| 7,658,831 | B2 | 2/2010 | Mathieu et al. |
| 7,705,456 | B2 | 4/2010 | Hu |
| 7,755,174 | B2 | 7/2010 | Rollin et al. |
| 7,898,356 | B2 | 3/2011 | Sherrer et al. |
| 7,948,335 | B2 | 5/2011 | Sherrer et al. |
| 8,011,959 | B1 | 9/2011 | Tsai |
| 8,031,037 | B2 | 10/2011 | Sherrer et al. |
| 8,304,666 | B2 | 11/2012 | Ko |
| 8,339,232 | B2 | 12/2012 | Lotfi |
| 8,441,118 | B2 | 5/2013 | Hua |
| 8,522,430 | B2 | 9/2013 | Kacker |
| 8,542,079 | B2 | 9/2013 | Sherrer |
| 2002/0075104 | A1 | 6/2002 | Kwon et al. |
| 2003/0029729 | A1 | 2/2003 | Cheng et al. |
| 2003/0052755 | A1 | 3/2003 | Barnes et al. |
| 2003/0117237 | A1 | 6/2003 | Niu |
| 2003/0221968 | A1 | 12/2003 | Cohen |
| 2003/0222738 | A1 | 12/2003 | Brown et al. |
| 2004/0004061 | A1 | 1/2004 | Merdan |
| 2004/0007468 | A1 | 1/2004 | Cohen |
| 2004/0007470 | A1 | 1/2004 | Smalley |
| 2004/0038586 | A1 | 2/2004 | Hall |
| 2004/0076806 | A1 | 4/2004 | Miyanaga et al. |
| 2004/0196112 | A1 | 10/2004 | Welbon |
| 2004/0263290 | A1 | 12/2004 | Sherrer et al. |
| 2005/0030124 | A1 | 2/2005 | Okamoto |
| 2005/0045484 | A1 | 3/2005 | Smalley et al. |
| 2005/0156693 | A1 | 7/2005 | Dove et al. |
| 2005/0230145 | A1 | 10/2005 | Ishii et al. |
| 2005/0250253 | A1 | 11/2005 | Cheung |
| 2008/0191817 | A1* | 8/2008 | Sherrer et al. ..... 333/244 |
| 2008/0199656 | A1 | 8/2008 | Nichols et al. |
| 2008/0240656 | A1 | 10/2008 | Rollin et al. |
| 2009/0154972 | A1 | 6/2009 | Tanaka |
| 2010/0015850 | A1 | 1/2010 | Stein |
| 2010/0109819 | A1 | 5/2010 | Houck et al. |
| 2010/0296252 | A1 | 11/2010 | Rollin et al. |
| 2011/0123783 | A1 | 5/2011 | Sherrer |
| 2011/0181376 | A1 | 7/2011 | Vanhille et al. |
| 2011/0181377 | A1 | 7/2011 | Vanhille et al. |
| 2011/0210807 | A1 | 9/2011 | Sherrer et al. |
| 2011/0273241 | A1 | 11/2011 | Sherrer et al. |
| 2013/0050055 | A1 | 2/2013 | Paradiso et al. |
| 2013/0127577 | A1 | 5/2013 | Lotfi |

FOREIGN PATENT DOCUMENTS

| | | |
|---|---|---|
| EP | 398019 | 4/1990 |
| EP | 485831 | 4/1991 |
| EP | 845831 | 6/1998 |
| EP | 911903 | 4/1999 |

(56) References Cited

FOREIGN PATENT DOCUMENTS

| | | |
|---|---|---|
| FR | 2086327 | 12/1971 |
| JP | 3027587 | 2/1991 |
| JP | 6085510 | 3/1994 |
| JP | 6302964 | 10/1994 |
| JP | H10-041710 | 2/1998 |
| WO | 0007218 | 2/2000 |
| WO | 0039854 | 7/2000 |
| WO | 0206152 | 1/2002 |
| WO | 02080279 | 10/2002 |
| WO | 2004004061 | 1/2004 |

OTHER PUBLICATIONS

European Examination Report dated Mar. 21, 2013 for EP Application No. 07150463.3.
Ali Darwish et al.; Vertical Balun and Wilkinson Divider; 2002 IEEE MTT-S Digest; pp. 109-112.
Brown et al., "A Low-Loss Ka-Band Filter in Rectangular Coax Made by Electrochemical Fabrication", submitted to Microwave and Wireless Components Letters, date unknown (downloaded from www.memgen.com, 2004).
Chwomnawang et al., "On-chip 3D Air Core Micro-Inductor for High-Frequency Applications Using Deformation of Sacrificial Polymer", Proc. SPIE, vol. 4334, pp. 54-62, Mar. 2001.
Cole, B.E., et al., Micromachined Pixel Arrays Integrated with CMOS for Infrared Applications, pp. 64-64 (2000).
Filipovic, et al., "Modeling, Design, Fabrication, and Performance of Rectangular u-Coaxial Lines and Components", Microwave Symposium Digest, 2006, IEEE; Jun. 1, 2006; pp. 1393-1396.
Franssila, S., Introduction to Microfabrication, (pp. 8) (2004).
Kenneth J. Vanhille et al.; Micro-Coaxial Imedance Transformers; Journal of Latex Class Files; vol. 6; No. 1; Jan. 2007.
Tummala et al.; "Microelectronics Packaging Handbook"; Jan. 1, 1989; XP002477031; pp. 710-714.
De Los Santos, H.J., Introduction to Microelectromechanical (MEM) Microwave Systems (pp. 4, 7-8, 13) (1999).
Deyong, C. et al., A Microstructure Semiconductor Thermocouple for Microwave Power Sensors, 1997 Asia Pacific Microwave Conference, pp. 917-919.
Elliott Brown/MEMGen Corporation, "RF Applications of EFAB Technology", MTT-S IMS 2003, pp. 1-15.
Engelmann et al., "Fabrication of High Depth-to-Width Aspect Ratio Microstructures", IEEE Micro Electro Mechanical Systems (Feb. 1992), pp. 93-98.
Frazier et al., "Metallic Microstructures Fabricated Using Photosensitive Polyimide Electroplating Molds", Journal of Microelectromechanical Systems, vol. 2, No. 2, Jun. 1993, pp. 87-94.
Ghodisian, B., et al., Fabrication of Affordable Metallic Microstructures by Electroplating and Photoresist Molds, 1996, pp. 68-71.
H. Guckel, "High-Aspect-Ratio Micromachining Via Deep X-Ray Lithography", Proc. of IEEE, vol. 86, No. 8 (Aug. 1998), pp. 1586-1593.
Hawkins, C.F., The Microelectronics Failure Analysis, Desk Reference Edition (2004).
Jeong, Inho et al., "High-Performance Air-Gap Transmission Lines and Inductors for Millimeter-Wave Applications", IEEE Transactions on Microwave Theory and Techniques, Dec. 2002, pp. 2850-2855, vol. 50, No. 12.
Katehi et al., "MEMS and Si Micromachined Circuits for High-Frequency Applications", IEEE Transactions on Microwave Theory and Techniques, vol. 50, No. 3, Mar. 2002, pp. 858-866.
Kwok, P.Y., et al., Fluid Effects in Vibrating Micromachined Structures, Journal of Microelectromechanical Systems, vol. 14, No. 4, Aug. 2005, pp. 770-781.
Lee et al., "Micromachining Applications of a High Resolution Ultrathick Photoresist", J. Vac. Sci. Technol. B 13 (6), Nov./Dec. 1995, pp. 3012-3016.
Loechel et al., "Application of Ultraviolet Depth Lithography for Surface Micromachining", J. Vac. Sci. Technol. B 13 (6), Nov./Dec. 1995, pp. 2934-2939.
Madou, M.J., Fundamentals of Microfabrication: The Science of Miniaturization, 2d Ed., 2002 (Roadmap; pp. 615-668).
Park et al., "Electroplated Micro-Inductors and Micro-Transformers for Wireless application", IMAPS 2002, Denver, CO, Sep. 2002.
Sedky, S., Post-Processing Techniques for Integrated MEMS (pp. 9, 11, 164) (2006).
Yeh, J.L., et al., Copper-Encapsulated Silicon Micromachined Structures, Journal of Microelectromechanical Systems, vol. 9, No. 3, Sep. 2000, pp. 281-287.
Yoon et al., "3-D Lithography and Metal Surface Micromachining for RF and Microwave MEMS" IEEE MEMS 2002 Conference, Las Vegas, NV, Jan. 2002, pp. 673-676.
Yoon et al., "CMOS-Compatible Surface Micromachined Suspended-Spiral Inductors for Multi-GHz Sillicon RF Ics", IEEE Electron Device Letters, vol. 23, No. 10, Oct. 2002, pp. 591-593.
Yoon et al., "High-Performance Electroplated Solenoid-Type Integrated Inductor (SI2) for RF Applications Using Simple 3D Surface Micromachining Technology", Int'l Election Devices Meeting, 1998, San Francisco, CA, Dec. 6-9, 1998, pp. 544-547.
Yoon et al., "High-Performance Three-Dimensional On-Chip Inductors Fabricated by Novel Micromahining Technology for RF MMIC", 1999 IEEE MTT-S Int'l Microwave Symposium Digest., vol. 4, Jun. 13-19, 1999, Anaheim, California, pp. 1523-1526.
Yoon et al., "Monolithic High-Q Overhang Inductors Fabricated on Silicon and Glass Substrates", International Electron Devices Meeting, Washington D.C. (Dec. 1999), pp. 753-756.
Yoon et al., "Monolithic Integration of 3-D Electroplated Microstructures with Unlimited Number of Levels Using Planarization with a Sacrificial Metallic Mole (PSMm)", Twelfth IEEE Int'l Conf. on Micro Electro mechanical systems, Orlando Florida, Jan. 1999, pp. 624-629.
Yoon et al., "Multilevel Microstructure Fabrication Using Single-Step 3D Photolithography and Single-Step Electroplating", Proc. of SPIE, vol. 3512, (Sep. 1998), pp. 358-366.
Sherrer, D, Vanhille, K, Rollin, J.M., "PolyStrata Technology: A Disruptive Approach for 3D Microwave Components and Modules," Presentation (Apr. 23, 2010).
Chance, G.I. et al., "A suspended-membrane balanced frequency doubler at 200GHz," 29th International Conference on Infrared and Millimeter Waves and Terahertz Electronics, pp. 321-322, Karlsrube, 2004.
Immorlica, Jr., T. et al., "Miniature 3D micro-machined solid state power amplifiers," COMCAS 2008.
Ehsan, N. et al., "Microcoaxial lines for active hybrid-monolithic circuits," 2009 IEEE MTT-S Int. Microwave.Symp. Boston, MA, Jun. 2009.
Filipovic, D. et al., "Monolithic rectangular coaxial lines. Components and systems for commercial and defense applications," Presented at 2008 IASTED Antennas, Radar, and Wave Propagation Conferences, Baltimore, MD, USA, Apr. 2008.
Filipovic, D.S., "Design of microfabricated rectangular coaxial lines and components for mm-wave applications," Microwave Review, vol. 12, No. 2, Nov. 2006, pp. 11-16.
Ingram, D.L. et al., "A 427 mW 20% compact W-band InP HEMT MMIC power amplifier," IEEE RFIC Symp. Digest 1999, pp. 95-98.
Lukic, M. et al., "Surface-micromachined dual Ka-band cavity backed patch antennas," IEEE Trans. AtennasPropag., vol. 55, pp. 2107-2110, Jul. 2007.
Oliver, J.M. et al., "A 3-D micromachined W-band cavity backed patch antenna array with integrated rectacoax transition to wave guide," 2009 Proc. IEEE International Microwave Symposium, Boston, MA 2009.
Rollin, J.M. et al., "A membrane planar diode for 200GHz mixing applications," 29th International Conference on Infrared and Millimeter Waves and Terahertz Electronics, pp. 205-206, Karlsrube, 2004.
Rollin, J.M. et al., "Integrated Schottky diode for a sub-harmonic mixer at millimetre wavelengths," 31st International Conference on Infrared and Millimeter Waves and Terahertz Electronics, Paris, 2006.

(56) References Cited

OTHER PUBLICATIONS

Saito et al., "Analysis and design of monolithic rectangular coaxial lines for minimum coupling," IEEE Trans. Microwave Theory Tech., vol. 55, pp. 2521-2530, Dec. 2007.
Vanhille, K. et al., "Balanced low-loss Ka-band μ-coaxial hybrids," IEEE MTT-S Dig., Honolulu, Hawaii, Jun. 2007.
Vanhille, K. et al., "Ka-Band surface mount directional coupler fabricated using micro-rectangular coaxial transmission lines," 2008 Proc. IEEE International Microwave Symposium, 2008.
Vanhille, K.J. et al., "Ka-band miniaturized quasi-planar high-Q resonators," IEEE Trans. Microwave Theory Tech., vol. 55, No. 6, pp. 1272-1279, Jun. 2007.
Vyas R. et al., "Liquid Crystal Polymer (LCP): The ultimate solution for low-cost RF flexible electronics and antennas," Antennas and Propagation Society, International Symposium, p. 1729-1732 (2007).
Wang, H. et al., "Design of a low integrated sub-harmonic mixer at 183GHz using European Schottky diode technology," From Proceedings of the 4th ESA workshop on Millimetre-Wave Technology and Applications, pp. 249-252, Espoo, Finland, Feb. 2006.
Wang, H. et al., "Power-amplifier modules covering 70-113 GHz using MMICs," IEEE Trans Microwave Theory and Tech., vol. 39, pp. 9-16, Jan. 2001.
Vanhille, K "Design and Characterization of Microfabricated Three-Dimensional Millimeter-Wave Components," Dissertation, 2007.
Ehsan, N., "Broadband Microwave Litographic 3D Components," Dissertation 2009.
Colantonio, P., et al., "High Efficiency RF and Microwave Solid State Power Amplifiers," pp. 380-395, 2009.
European Search Report of Corresponding European Application No. 07 15 0467 mailed Apr. 28, 2008.
European Search Report of corresponding European Application No. 08 15 3138 mailed Jul. 4, 2008.
Yoon et al., "High-Performance Electroplated Solenoid-Type Integrated Inductor (S12) for RF Applications Using Simple 3D Surface Micromachining Technology", Int'l Election Devices Meeting, 1998, San Francisco, CA, Dec. 6-9, 1998, pp. 544-547.
European Examination Report of corresponding European Patent Application No. 08 15 3144 dated Nov. 10, 2008.
European Examination Report of corresponding European Patent Application No. 08 15 3144 dated Apr. 6, 2010.
European Examination Report of corresponding European Patent Application No. 08 15 3144 dated Feb. 22, 2012.
European Search Report of corresponding European Patent Application No. 08 15 3144 dated Jul. 2, 2008, Jul. 7, 2008.
Saito, Y., Fontaine, D., Rollin, J-M., Filipovic, D., 'Micro-Coaxial Ka-Band Gysel Power Dividers,' Microwave Opt Technol Lett 52: 474-478, 2010, Feb. 2010.
Written Opinion of the International Searching Authority dated Aug. 29, 2005 on corresponding PCT/US04/06665.
International Preliminary Report on Patentability dated May 19, 2006 on corresponding PCT/US04/06665.
International Search Report dated Aug. 29, 2005 on corresponding PCT/US04/06665.
European Search Report for corresponding EP Application No. 07150463.3 dated Apr. 23, 2012.
Jeong, I., et al., "High Performance Air-Gap Transmission Lines and Inductors for Milimeter-Wave Applications", Transactions on Microwave Theory and Techniques, vol. 50, No. 12, Dec. 2002.
PwrSoC Update 2012: Technology, Challenges, and Opportunities for Power Supply on Chip, Presentation (Mar. 18, 2013).

* cited by examiner

THERMAL MANAGEMENT

The present application claims priority to U.S. Provisional Patent Application No. 61/297,715 (filed on Jan. 22, 2010), which is hereby incorporated by reference in its entirety.

BACKGROUND

Embodiments relate to electric, electronic and/or electromagnetic devices, and/or thermal management thereof. Some embodiments relate to transmission lines and/or thermal management thereof, for example thermal energy management of waveguide structures. Some embodiments relate to a thermal manager, for example thermal jumpers, and/or transmission line structures including one or more thermal managers.

There may be a need for one or more conductors of a transmission line system to be substantially thermally isolated, which may minimize electrical dissipative loss, e.g. air-loaded transmission lines. There may be a need for efficient and/or effective thermal energy management of one or more conductors of a transmission line, for example an inner and/or outer conductor of a waveguide structure. There may be a need for a thermal manager that may be fabricated and/or included in a transmission line system which may minimize cost, fabrication complexity and/or size while maximizing the thermal energy management of a system. There may be a need for a device including one or more thermal energy managers which may maximize tuning of electrical and/or electromagnetic properties, for example radio frequency structures which may maximize radio frequency signal output.

SUMMARY

Embodiments relate to electric, electronic and/or electromagnetic devices, and/or thermal management thereof. Some embodiments relate to transmission lines and/or thermal management thereof, for example thermal energy management of waveguide structures. Some embodiments relate to a thermal manager, for example thermal jumpers, and/or transmission line structures including one or more thermal managers.

Embodiments relate to thermal management, for example thermal energy management of a transmission line. According to embodiments, a transmission line may include a waveguide structure having one or more inner conductors surrounded by one or more outer conductors on two or more sides, for example on three sides. According to embodiments, a waveguide structure may include a coaxial waveguide structure and/or any other structure which may provided a guided mode, for example a port structure of a balun structure. In embodiments, one or more inner conductors and/or one or more outer conductors may be a signal conductor. In embodiments, one or more outer conductors may be one or more sidewalls of a waveguide structure. In embodiments, one or more sidewalls of a waveguide structure may be a ground plane.

According to embodiments, one or more inner conductors of a transmission line may be spaced apart from one or more outer conductors. According to embodiments, one or more inner conductors may be spaced apart from one or more outer conductors by an insulative material. In embodiments, an insulative material may include a gas, such as air, a dielectric material and/or vacuum.

According to embodiments, a thermal manager (e.g., a jumper) may include a thermal member. In embodiments, a part of a thermal member may be formed of an electrically insulative and thermally conductive material. In embodiments, thermally conductive and electrically insulative material may include one or more of a ceramic, aluminum oxide, aluminum nitride, alumina, beryllium oxide, silicon carbide, sapphire, quartz, PTFE and/or diamond (e.g. synthetic and/or natural) material. In embodiments, a thermal member may be formed of a thermally conductive material, for example a metal. According to embodiments, a thermal member may be configured to form a thermal path, for example away from one or more inner conductors of a transmission line.

According to embodiments, a thermal member may include a thermal cap. In embodiments, a thermal member (e.g., thermal cap) may be partially and/or substantially accessible, for example partially and/or substantially accessible from outside an outer conductor (e.g., an outer conductor of a transmission line). In embodiments, a thermal member (e.g., thermal cap) cap may be partially and/or substantially accessible by being partially disposed outside a transmission line (e.g, partially disposed outside an outer conductor). In embodiments, a thermal member (e.g., thermal cap) may be partially and/or substantially accessible by being exposed from outside a transmission line (e.g., exposed outside an outer conductor).

According to embodiments, a thermal member (e.g., thermal cap) may be configured to thermally contact one or more inner conductors and/or outer conductors. In embodiments, a thermal member (e.g., thermal cap) may be configured to thermally contact, for example, one or more inner conductors through a post. In embodiments, a post may be formed of an electrically insulative and thermally conductive material. In embodiments, a post may be configured to partially and/or substantially pass through an opening disposed in an outer conductor.

According to embodiments, a thermal member may include a thermal substrate. In embodiments, a thermal substrate may be located proximate to a transmission line. In embodiments, a thermal substrate may operate as a substrate on which a transmission line is formed and/or is supported. In embodiments, a thermal substrate may be configured to thermally contact one or more inner conductors. In embodiments, a thermal substrate may be configured to thermally contact one or more inner conductors through a post. In embodiments, a post may be formed of an electrically insulative and thermally conductive material. In embodiments, a post may be configured to partially and/or substantially pass through an opening disposed in an other conductor.

According to embodiments, a thermal manager may be attached to one or more inner conductors and/or one or more outer conductors in any suitable manner. In embodiments, for example, a thermal manager may be attached by adhesive. In embodiments, an adhesive may be formed of a thermally conductive and electrically insulative material. In embodiments, an adhesive may be formed of an electrically conductive material. In embodiments, an adhesive may be substantially to maximize thermal energy transfer. In embodiments, an adhesive may include an epoxy.

According to embodiments, a thermal member may be a post. In embodiments, a thermal member may be connected to an external heat sink. In embodiments, an external heat sink may be any sink which may transfer thermal energy away from a thermal member. In embodiments, for example, an external heat sink may include active and/or passive devices and/or materials, for example the convection of air, fluid low, metal studs, thermoelectric cooling, etc.

Embodiments relate to a transmission line structure. In embodiments, a transmission line structure may include one or more outer conductors, one or more inner conductors, and/or one or more thermal managers in accordance with aspects of embodiments. In embodiments, the geometry of one or more inner conductors, one or more outer conductors and/or one or more thermal managers may vary and/or may be configured to maximize transmission of a signal, for example when a signal has a frequency above approximately 1 GHz. In embodiments, the cross-sectional area of one or more inner conductors may be minimized. In embodiments, the distance between of one or more inner conductors and/or one or more outer conductors may be maximized. In embodiments, the size of a thermal member may be minimized.

According to embodiments, a portion and/or substantially an entire transmission line structure may be formed employing any suitable process. In embodiments, a portion and/or substantially an entire transmission line structure may be formed employing one or more of a lamination process, a pick-and-place process, a deposition process, an electroplating process and/or a transfer-binding process, for example in a sequential build process.

DRAWINGS

Example FIG. 1 illustrates a transverse cross-section of a transmission line structure including a thermal energy manager in accordance with one aspect of embodiments.

Figure 2:
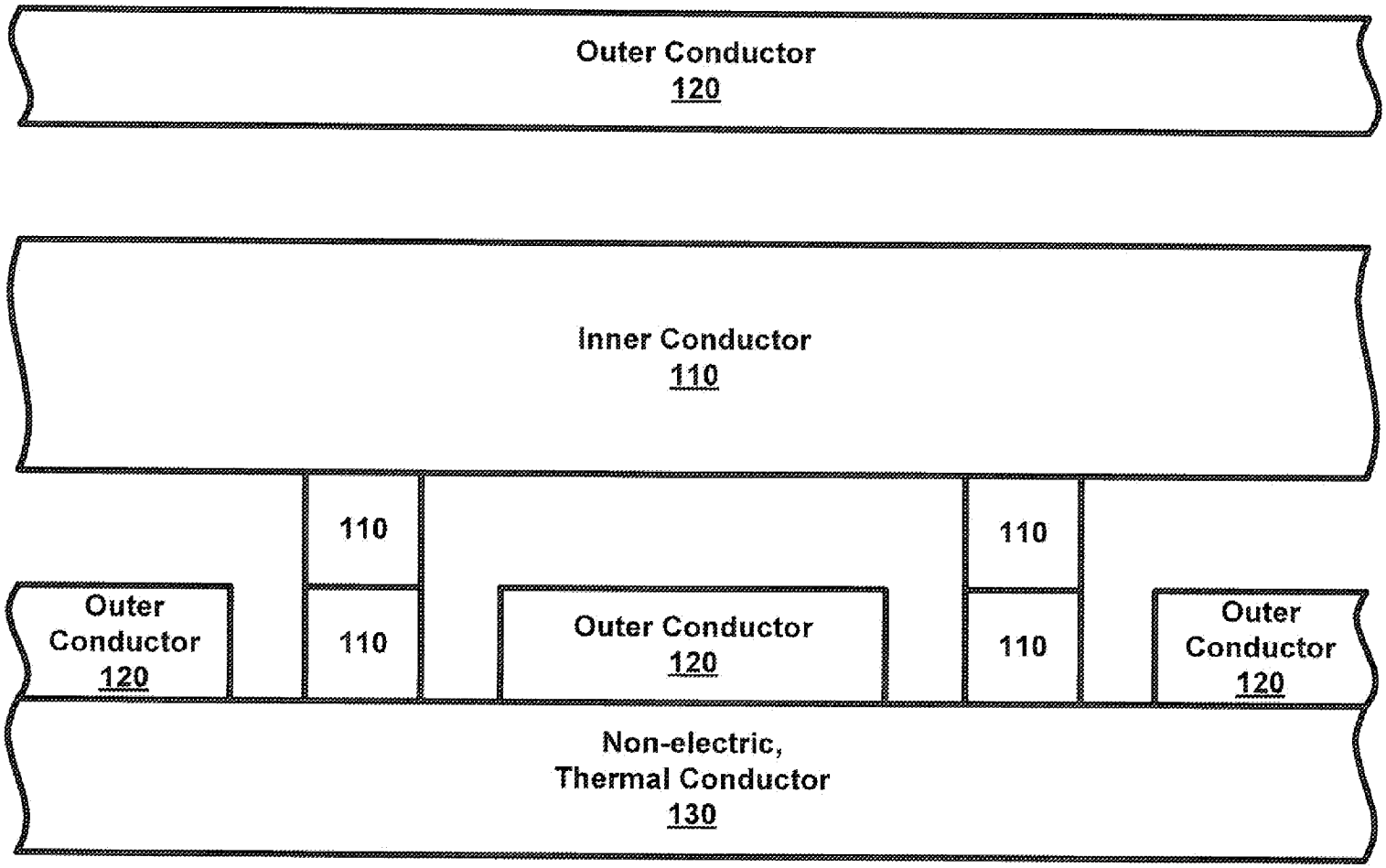

Example FIG. 2 illustrates a longitudinal cross-section of a transmission line structure including a thermal energy manager in accordance with one aspect of embodiments.

Figure 3:
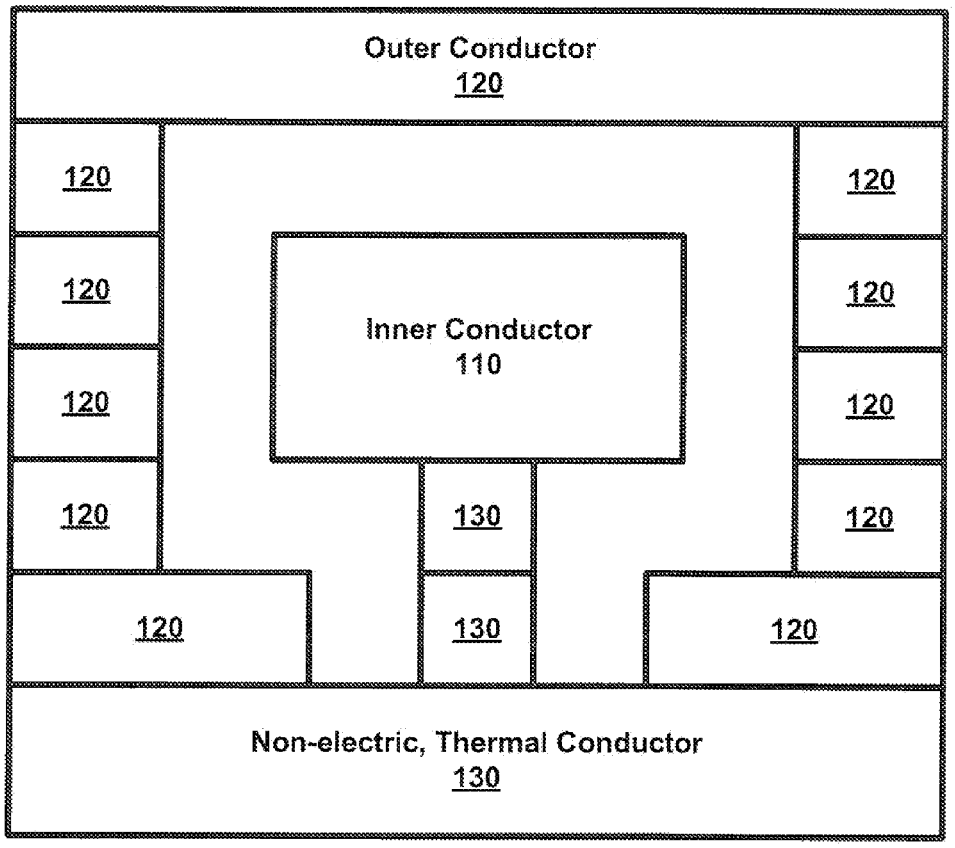

Example FIG. 3 illustrates a transverse cross-section of a transmission line structure including a thermal energy manager in accordance with one aspect of embodiments.

Figure 4:
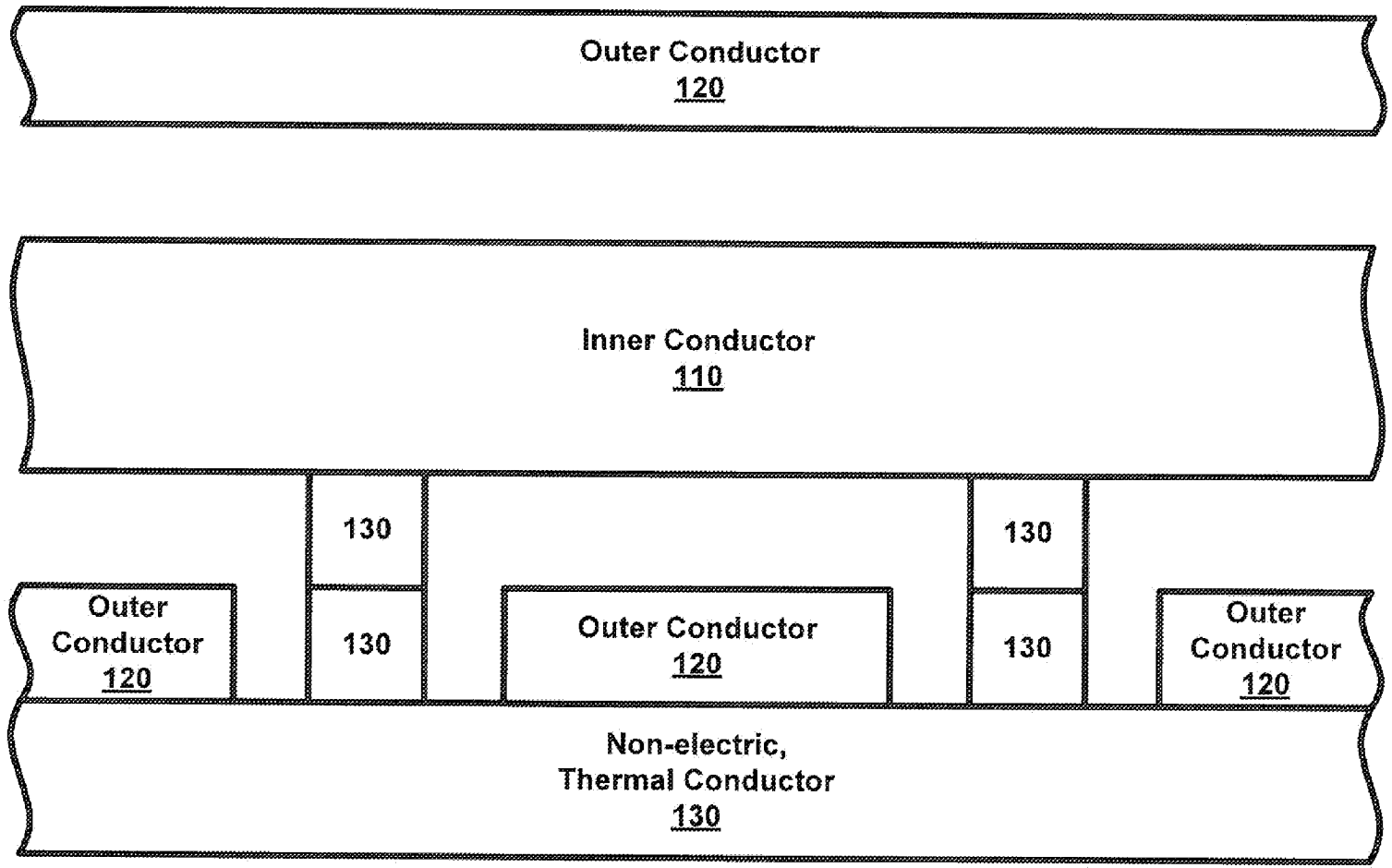

Example FIG. 4 illustrates a longitudinal cross-section of a transmission line structure including a thermal energy manager in accordance with one aspect of embodiments.

Figure 5:
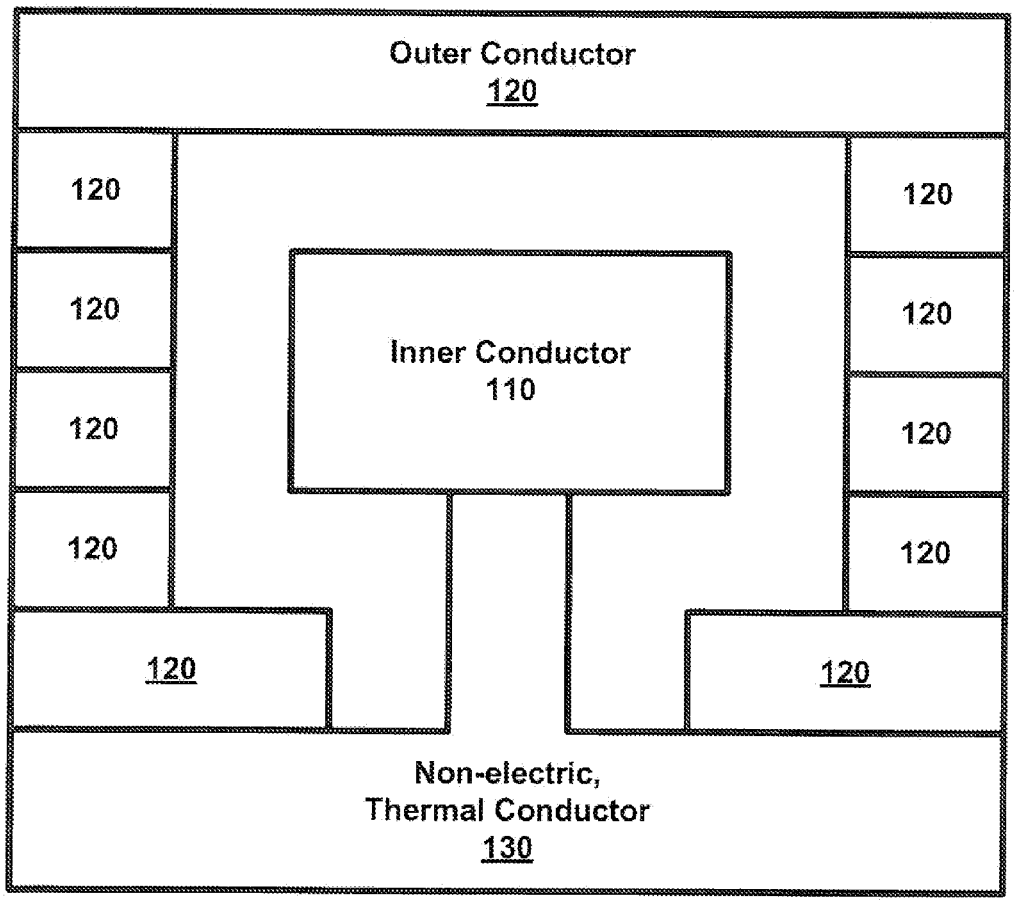

Example FIG. 5 illustrates a transverse cross-section of a transmission line structure including a thermal energy manager in accordance with one aspect of embodiments.

Figure 6:
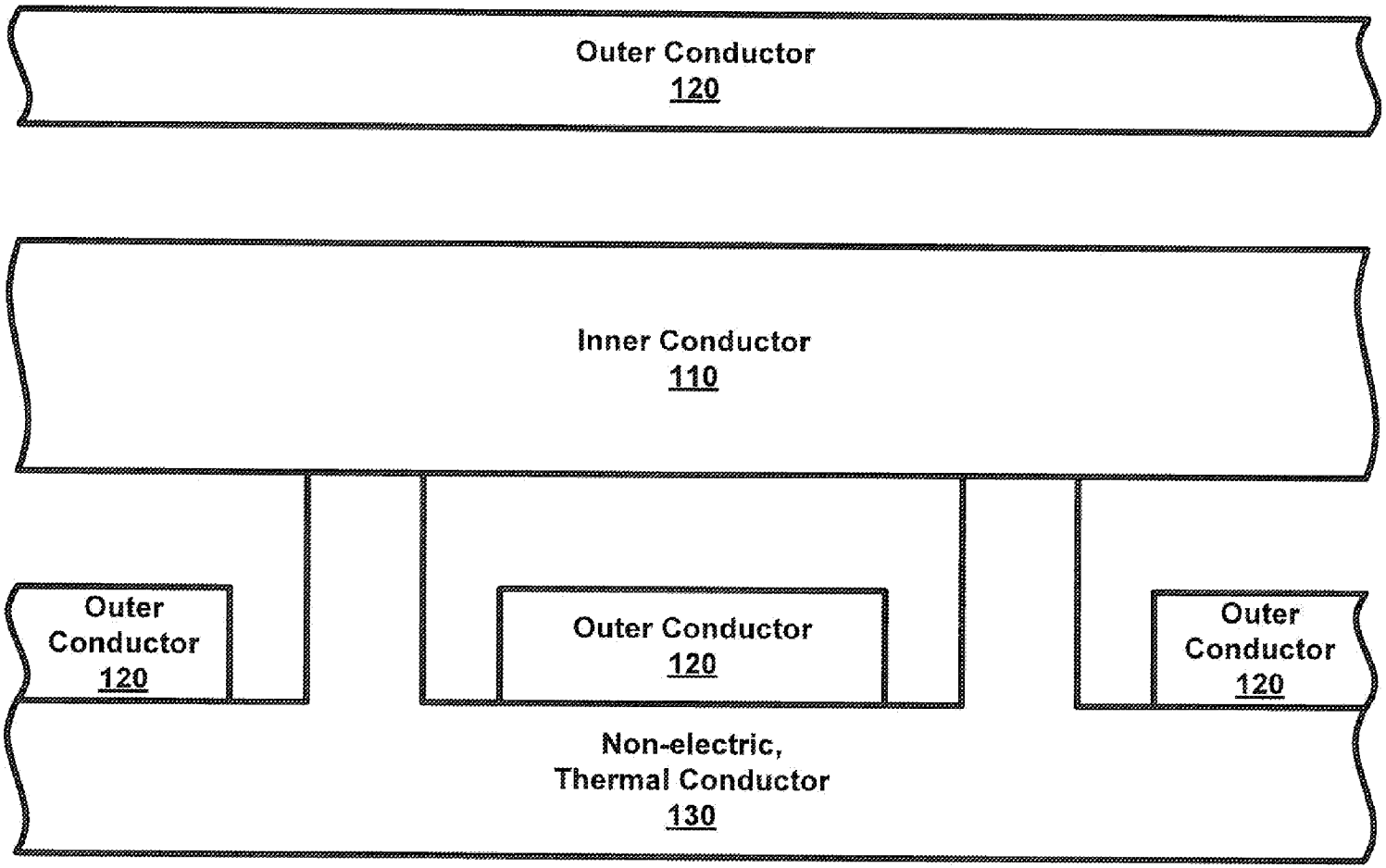

Example FIG. 6 illustrates a longitudinal cross-section of a transmission line structure including a thermal energy manager in accordance with one aspect of embodiments.

Figure 7:
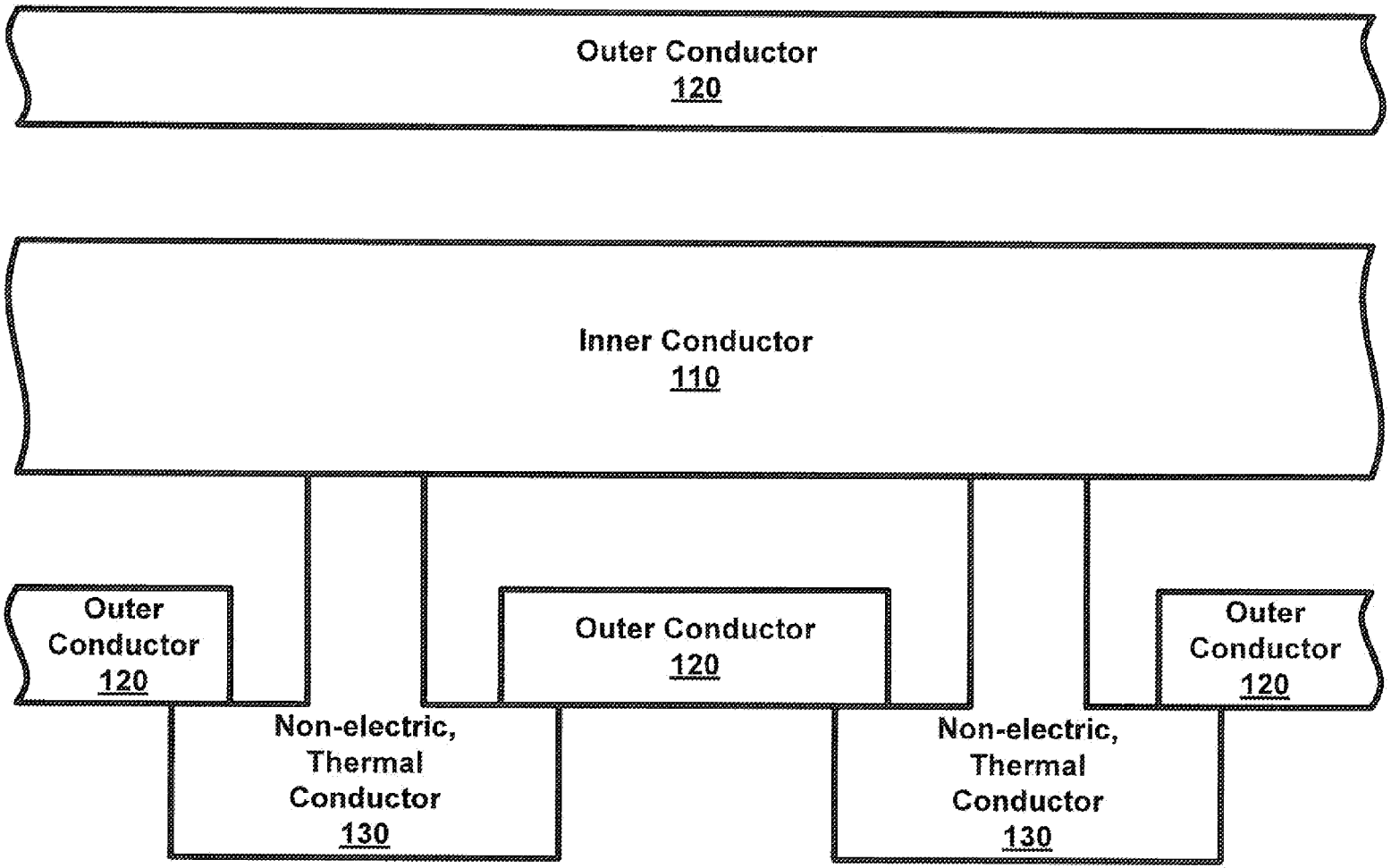

Example FIG. 7 illustrates a longitudinal cross-section of a transmission line structure including a thermal energy manager in accordance with one aspect of embodiments.

Figure 8:
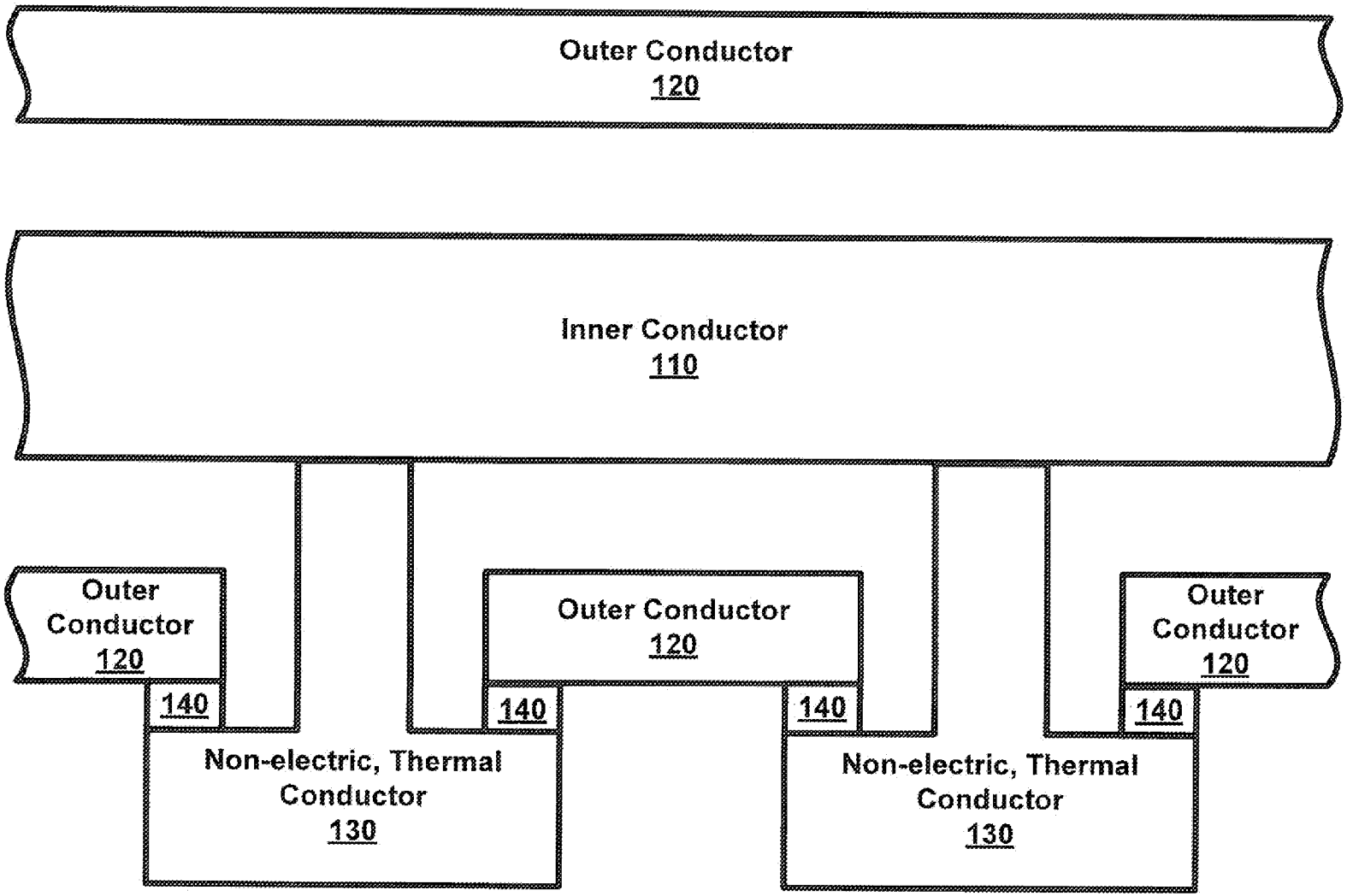

Example FIG. 8 illustrates a longitudinal cross-section of a transmission line structure including a thermal energy manager in accordance with one aspect of embodiments.

Figure 9:
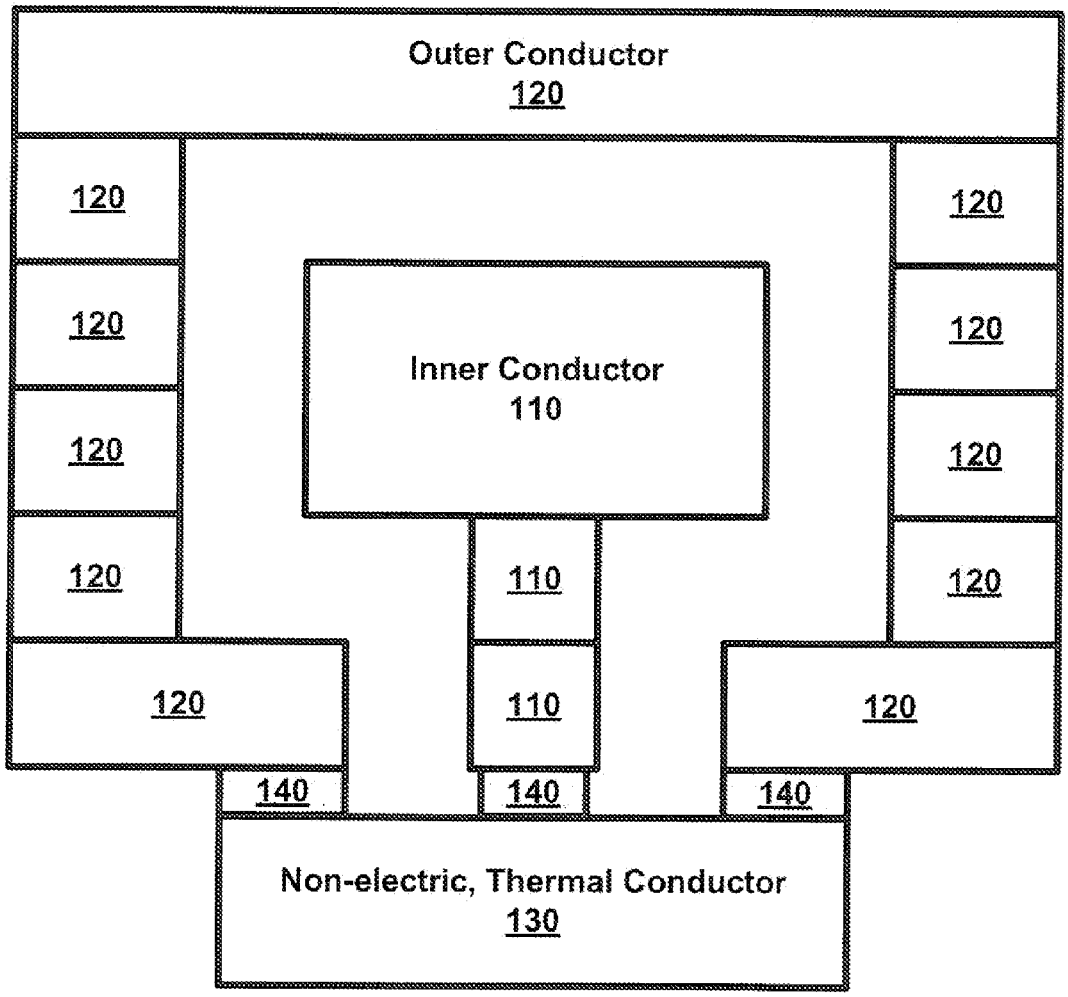

Example FIG. 9 illustrates a transverse cross-section of a transmission line structure including a thermal energy manager in accordance with one aspect of embodiments.

Figure 10:
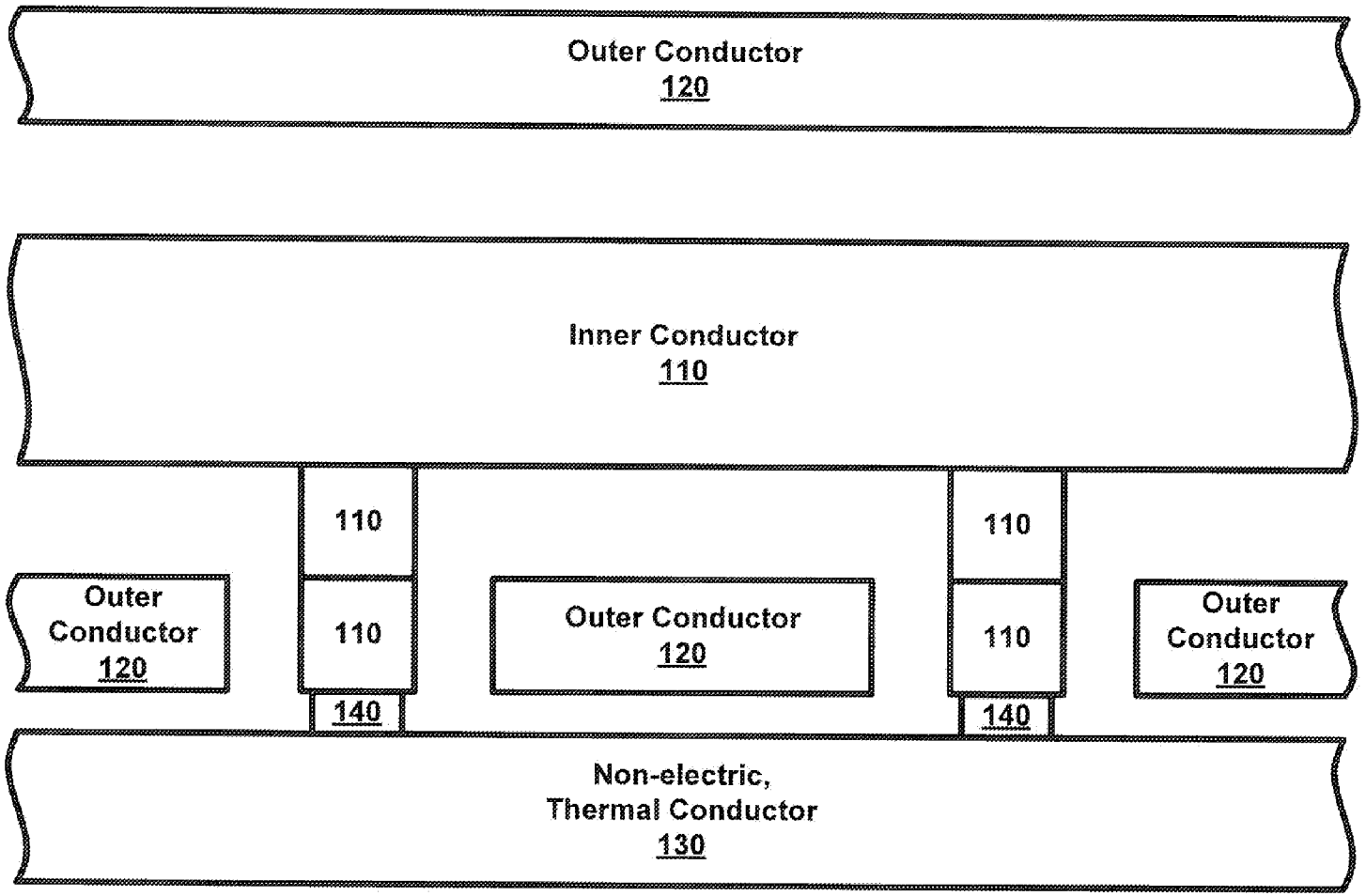

Example FIG. 10 illustrates a longitudinal cross-section of a transmission line structure including a thermal energy manager in accordance with one aspect of embodiments.

Figure 11:
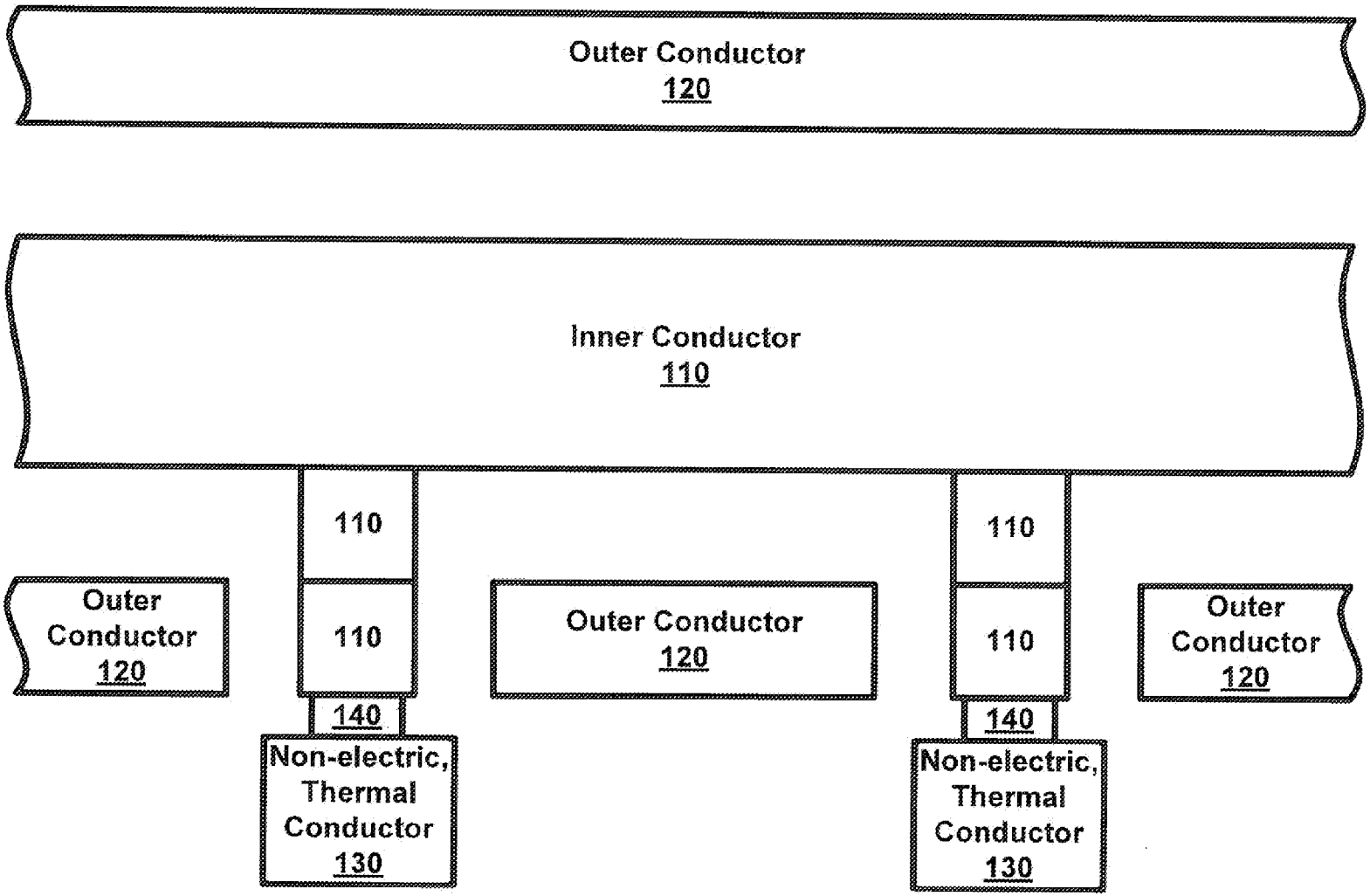

Example FIG. 11 illustrates a longitudinal cross-section of a transmission line structure including a thermal energy manager in accordance with one aspect of embodiments.

Figure 12:
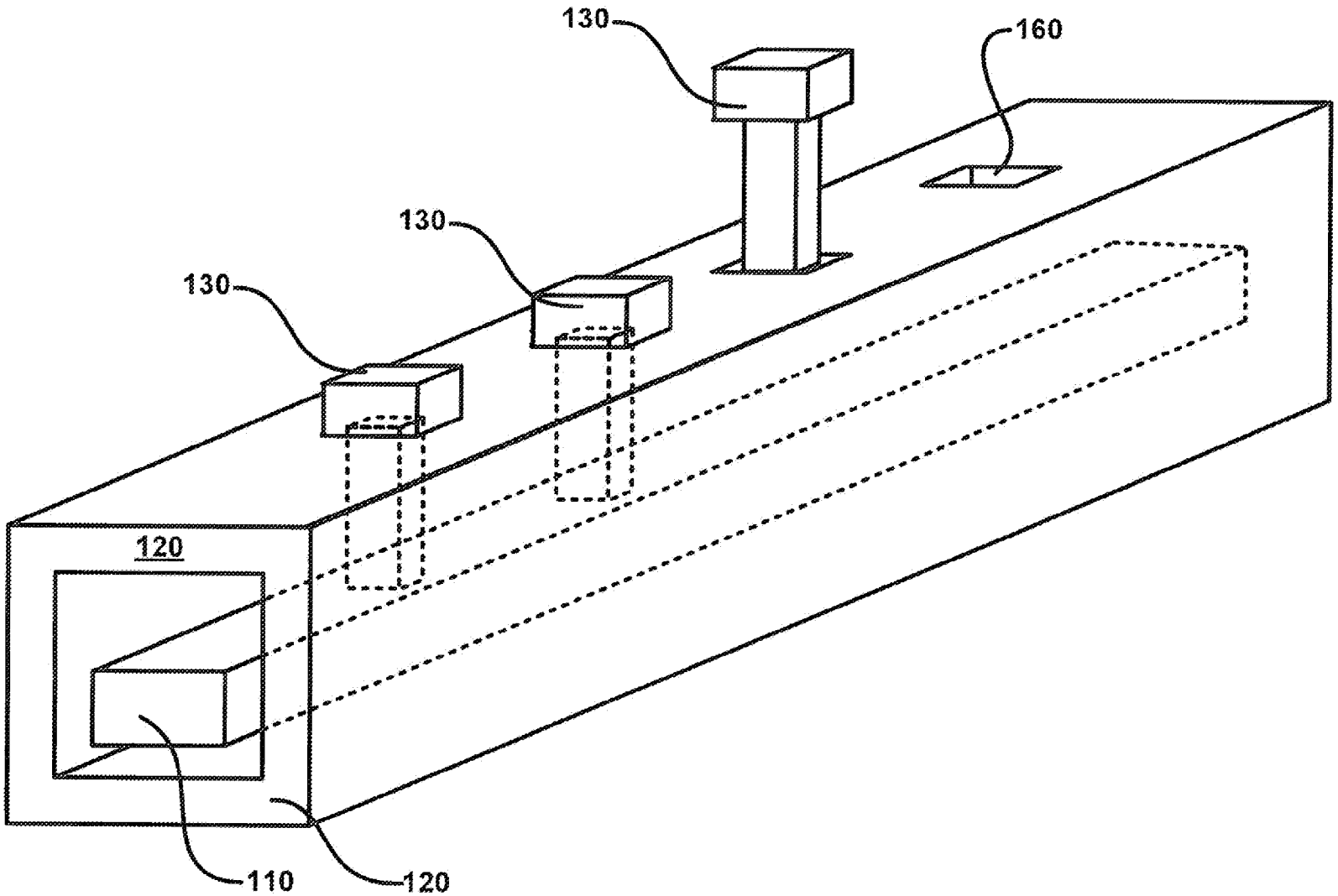

Example FIG. 12 illustrates a plan view of a transmission line structure including a thermal energy manager in accordance with one aspect of embodiments.

Figure 13:
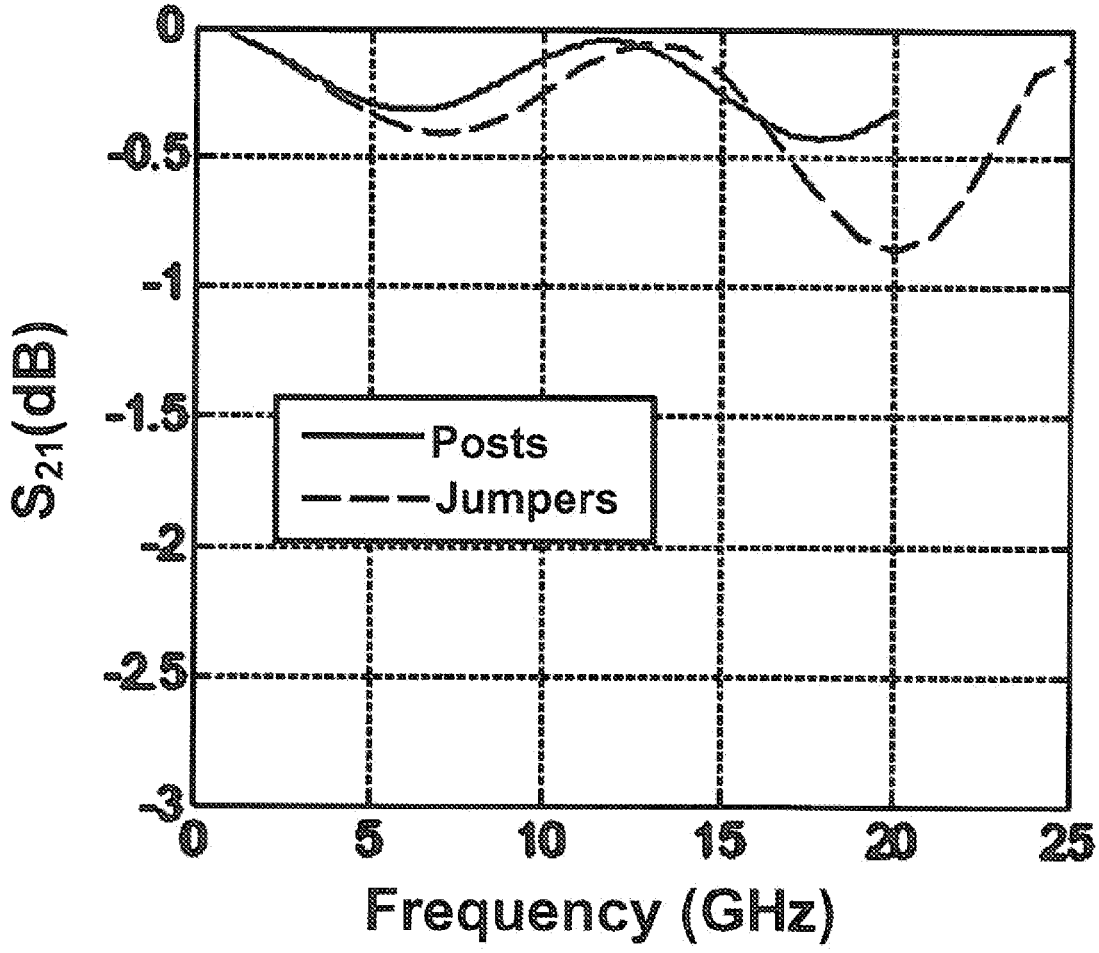

Example FIG. 13 illustrates minimized electrical loss which may be maintained in a transmission line structure including a thermal energy manager in accordance with one aspect of embodiments.

Figure 14A:
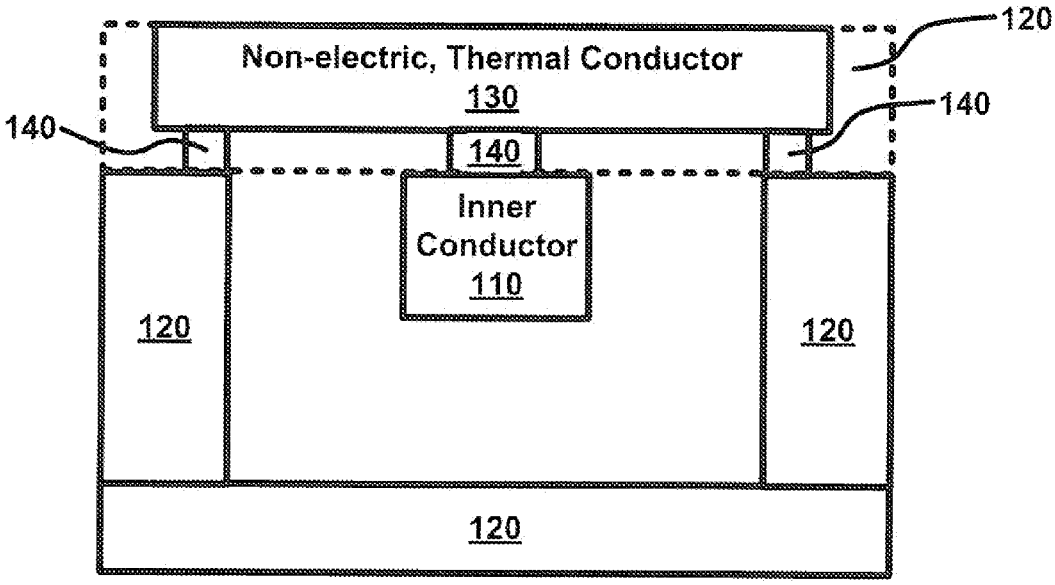
Figure 14B:
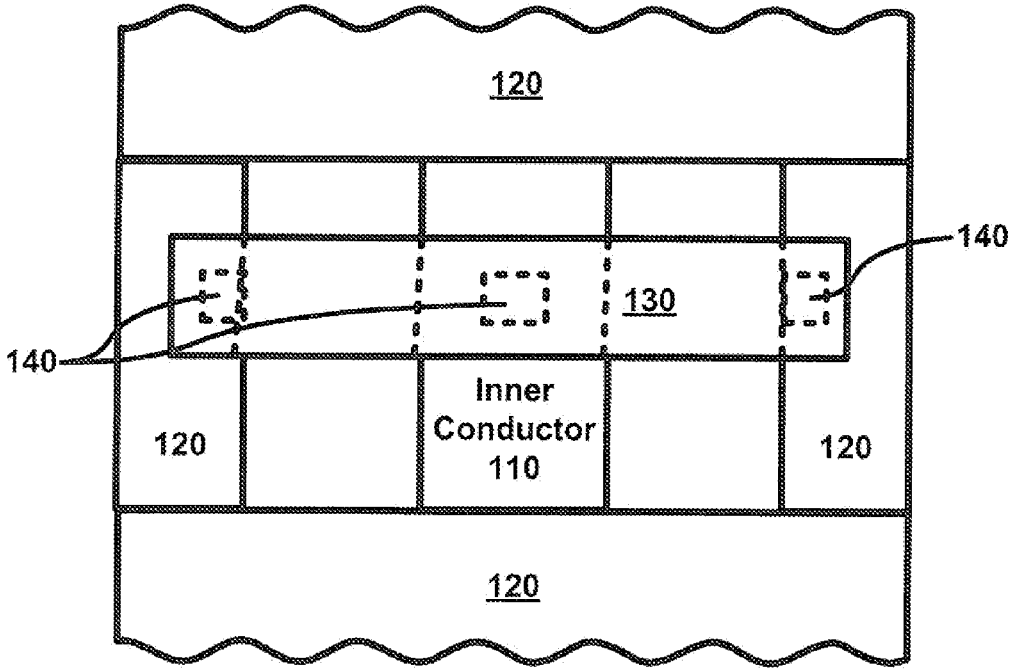
Figure 14C:
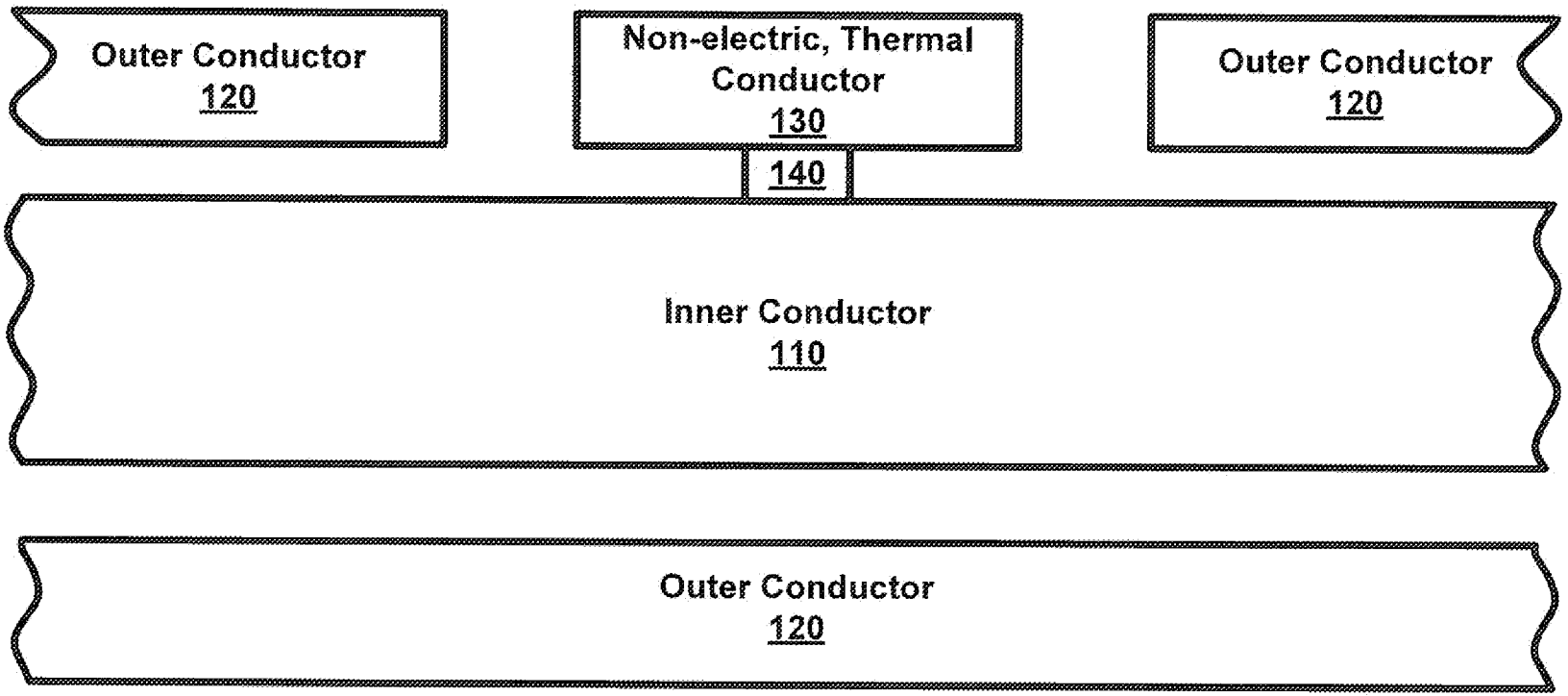

Example FIG. 14A to FIG. 14C illustrates a transverse cross-section, a top longitudinal view, and a longitudinal cross section, respectively, of a transmission line structure including a thermal energy manager in accordance with one aspect of embodiments.

Figure 15A:
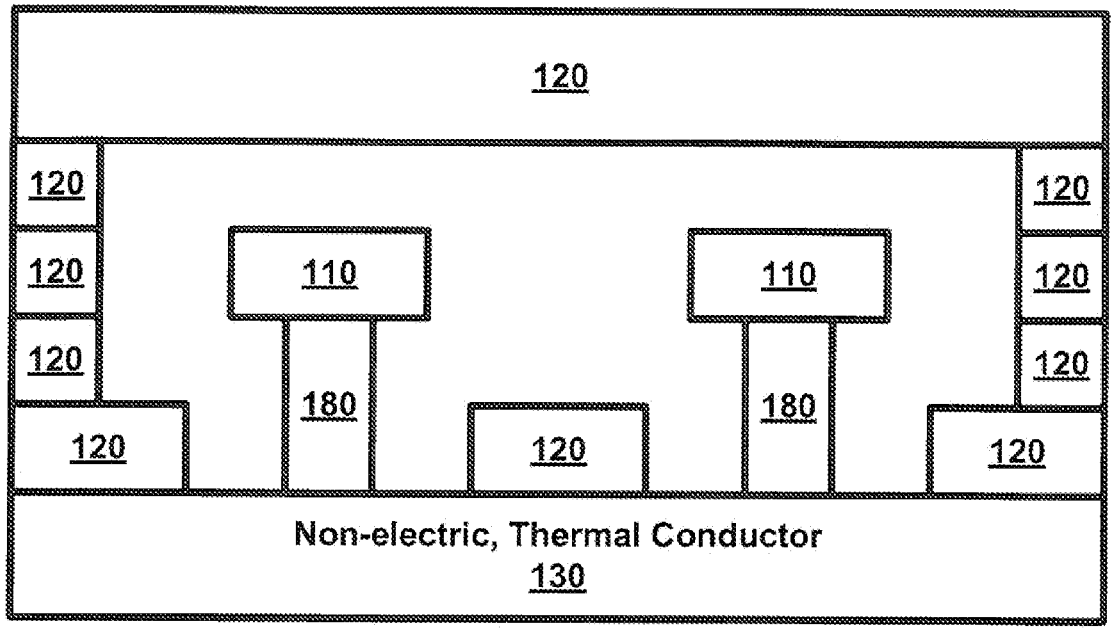
Figure 15B:
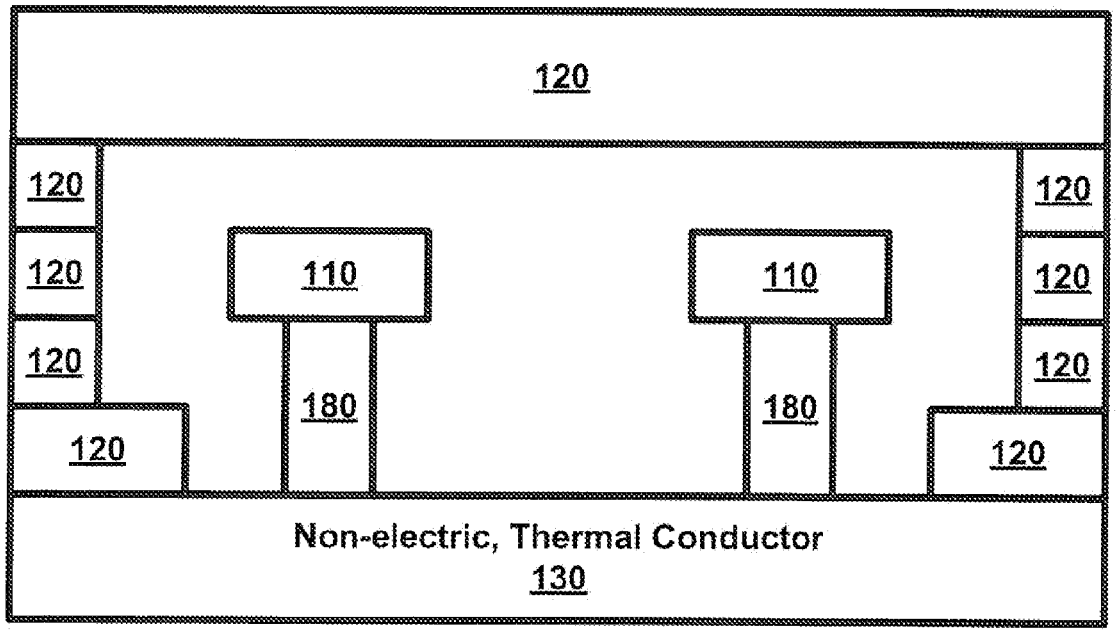

Example FIG. 15A to FIG. 15B illustrates a transverse cross-section of a transmission line structure including a thermal energy manager in accordance with one aspect of embodiments.

Figure 16B:
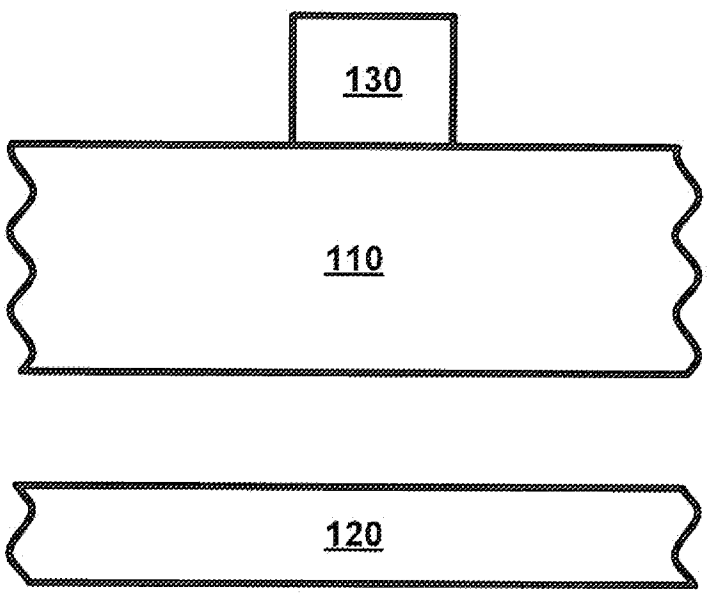
Figure 16A:
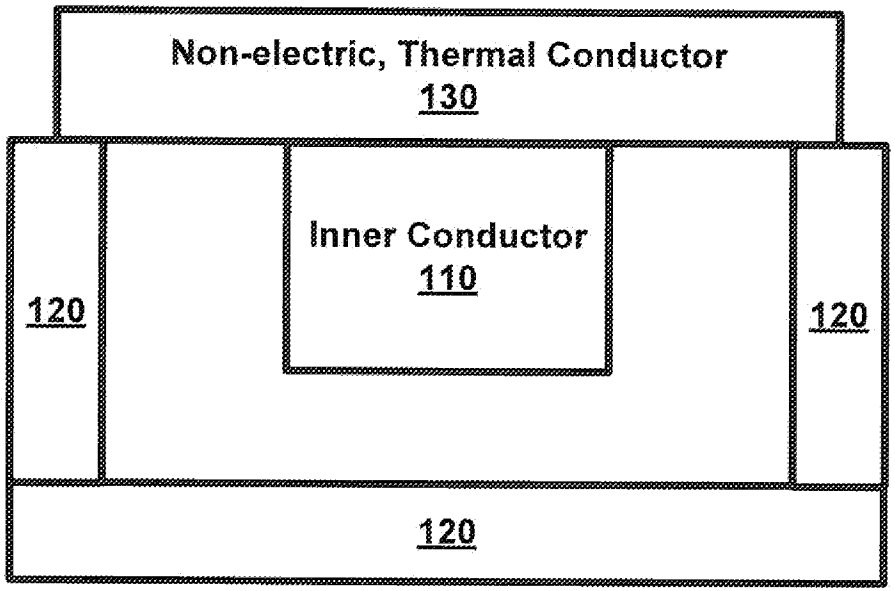

Example FIG. 16A to FIG. 16B illustrates a transverse cross-section and a longitudinal cross section, respectively, of a transmission line structure including a thermal energy manager in accordance with one aspect of embodiments.

DESCRIPTION

Embodiments relate to electric, electronic and/or electromagnetic devices, and/or thermal management thereof. Some embodiments relate to transmission lines and/or thermal management thereof, for example thermal energy management of waveguide structures. Some embodiments relate to a thermal manager, for example thermal jumpers, and/or transmission line structures including one or more thermal managers.

Embodiments relate to thermal management, for example thermal energy management of a transmission line. According to embodiments, a transmission line may include one or more waveguide structure having one or more inner conductors surrounded by one or more outer conductors on two or more sides, for example on three sides. In embodiments, one or more waveguide structures may include a coaxial waveguide structure and/or any other structure which may provided a guided mode, for example a port structure of a balun structure. In embodiments, one or more inner conductors and/or one or more outer conductors may be a signal conductor. In embodiments, one or more waveguide structures may have any suitable configuration, for example including a portion having a configuration as illustrated in U.S. Pat. Nos. 7,012,489, 7,649,432, 7,656,256 and/or U.S. patent application Ser. No. 13/011,886, each of which are incorporated by reference herein in their entireties. In embodiments, for example, one or more waveguide structures may include a meandered configuration. In embodiments, one or more waveguide structures may include one or more support members formed of insulative material, for example to support an inner conductor.

Referring to example FIG. 1, a transmission line may include a coaxial waveguide structure having inner conductor 110 surrounded by outer conductor 120 on each side of inner conductor 110 in accordance with one aspect of embodiments. As illustrated in one aspect of embodiments at FIG. 1, outer conductor 120 may be one or more sidewalls of a waveguide structure. Referring to example FIG. 14A to 14C and 16A to FIG. 16B, a transmission line may include a waveguide structure having inner conductor 110 surrounded by outer conductor 120 on three sides of conductor 110 in accordance with one aspect of embodiments. In embodiments, inner conductor 110 illustrated in one aspect of embodiments in FIG. 14A to 14C and/or 16A to FIG. 16B may have any desired configuration, for example the waveguide structure configuration illustrated in FIG. 1, a solid block configuration and/or any other configuration having one or more signal conductors. In embodiments, one or more sidewalls of a waveguide structure may be a ground plane. As illustrated in one aspect of embodiments at FIG. 14 to FIG. 14C and/or FIG. 16A to FIG. 16B, lower sidewall 120 may be a ground plane, for example when inner conductor 110 (e.g., relative to outer conductor 120) includes a substantially solid block of conductive material and/or includes a coaxial waveguide structure as illustrated in FIG. 1.

According to embodiments, one or more inner conductors of a transmission line may be spaced apart from one or more outer conductors. Referring back to example FIG. 1, inner conductor 110 may be spaced apart from outer conductor 120. According to embodiments, one or more inner conductors may be spaced apart from one or more outer conductors by an insulative material. In embodiments, an insulative material may include a gas, such as air, argon, nitrogen, etc. In embodiments, an insulative material may include a dielectric material, for example a resist material. In embodiments, an insulative material may include application of a vacuum.

According to embodiments, a thermal manager (e.g., a jumper) may include a thermal member. In embodiments, a part of a thermal member may be formed of an electrically insulative and thermally conductive material. In embodiments, thermally conductive and electrically insulative material may include one or more of a ceramic, aluminum oxide, aluminum nitride, alumina, beryllium oxide, silicon carbide, sapphire, quartz, PTFE and/or diamond (e.g. synthetic and/or natural) material. In embodiments, a thermal member may be formed of a thermally conductive material, for example a metal such as copper, metal alloy, and the like. In embodiments, a thermal member may be configured to form a thermal path. As illustrated in one aspect of embodiments in FIG. 1, thermal member 130 formed of electrically insulative and thermally conductive material may be configured to from a thermal path away from inner conductor 110.

According to embodiments, a thermal member may include a thermal cap. In embodiments, a thermal cap may partially and/or substantially overlay one or more openings of an outer conductor. As illustrated in one aspect of embodiments at example FIG. 7 to FIG. 12 and FIG. 14A to FIG. 14C, thermal member 130 includes a thermal cap substantially overlaying one or more openings of outer conductor 120 (e.g., FIG. 7) or partially overlaying one or more openings of outer conductor 120 (e.g., FIG. 11). In embodiments, a thermal member may be partially and/or substantially accessible. As illustrated in one aspect of embodiments in FIG. 7, thermal member 130 including a thermal cap is partially accessible from outside outer conductor 120, for example by being partially disposed outside outer conductor 120.

As illustrated in one aspect of embodiments at FIG. 11, thermal member 130 including a thermal cap is substantially accessible by being substantially disposed outside outer conductor 120. According to embodiments, any suitable configuration may be employed. In embodiments, for example, a thermal member (e.g., thermal cap) may be partially and/or substantially accessible by being exposed from outside a transmission line, for example by being disposed in one or more openings of an outer conductor. In embodiments, for example, a thermal member (e.g., thermal cap) may be partially and/or substantially accessible by being exposed from outside a transmission line and/or by being exposed through one or more openings of an outer conductor.

According to embodiments, a thermal member including a thermal cap may be configured to thermally contact one or more inner conductors and/or outer conductors. In embodiments, one or more thermal members including one or more thermal caps may be configured to thermally contact one or more inner conductors through one or more posts and/or one or more openings. Referring back to FIG. 7, thermal member 130 including a thermal cap may be configured to thermally contact inner conductor 110 through a post. As illustrated in one aspect of embodiments in FIG. 7, a thermal member including a thermal cap may be configured to contact outer conductor 120. Referring to FIG. 9 and FIG. 10, thermal member 130 including a thermal cap may be configured to contact inner conductor 110 though a plurality of posts and/or a plurality of openings of outer conductor 120. In embodiments, a post may be configured to partially and/or substantially pass through an opening disposed in an other conductor. Referring back to FIG. 7, a post is configured to pass completely through an opening of outer conductor 120.

According to embodiments, a post may be formed of an electrically insulative and thermally conductive material. In embodiments, a post may be made of an electrically conductive material, for example a metal. In embodiments, an inner conductor and/or an outer conductor and one or more posts may be formed of the same material. As illustrated in one aspect of embodiments in FIG. 1, a post may be firmed of the same material as inner conductor 110. In embodiments, a thermal cap and one or more posts may be formed of the same material.

Referring to FIG. 3 to FIG. 8, a thermal cap may be formed of the same material as one or more posts. In embodiments, one or more posts may be part of one or more inner conductors, one or more thermal members and/or one or more outer conductors. As illustrated in one aspect of embodiments in FIG. 12, one or more thermal managers may include one or more thermal members 130 having one or more posts formed of the same material. In embodiments, one or more posts may traverse one or more openings 160 of outer conductor 120.

According to embodiments, one or more posts may be formed of a different material than an inner conductor, outer conductor and a thermal cap, as illustrated in one aspect of embodiments at FIG. 15A to FIG. 15B. In embodiments, different materials may be chemically different and have the same conductive properties (e.g., the same amount of thermal conductivity and/or insulative property).

According to embodiments, a thermal member may include a thermal substrate. In embodiments, a thermal substrate may be located proximate a transmission line. In embodiments, a thermal substrate may operate as a substrate on which a transmission line is formed and/or is supported. As illustrated in one aspect of embodiments at FIG. 1 to FIG. 6 and FIG. 15A to FIG. 15B, a thermal member 130 may include a thermal substrate on which a transmission line is formed and/or is supported. In embodiments, for example as illustrated in FIG. 9, a thermal member including a thermal cap may also support a waveguide structure at desired locations. In embodiments, a thermal substrate may be modified to form any desired geometry, including the geometry of a thermal cap.

According to embodiments, a thermal member including a thermal substrate may be configured to thermally contact one or more inner conductors and/or outer conductors. In embodiments, one or more thermal members including a thermal substrate may be configured to thermally contact one or more inner conductors through one or more posts and/or one or more openings. Referring back to FIG. 1, thermal member 130 including a thermal substrate may be configured to thermally contact inner conductor 110 through a post. As illustrated in one aspect of embodiments in FIG. 1, a thermal member including a thermal substrate may be configured to contact outer conductor 120. Referring to FIG. 15A to FIG. 15B, thermal member 130 including a thermal substrate may be configured to contact a plurality of conductors 110 though a plurality of posts 180 and/or a plurality of openings of outer conductor 120.

According to embodiments, a thermal manager may be attached to one or more inner conductors and/or one or more outer conductors in any suitable manner. In embodiments, for example, a thermal manager may be attached by adhesive material. In embodiments, an adhesive may be formed of a thermally conductive and electrically insulative material. In embodiments, an adhesive may be formed of an electrically conductive material, for example a conductive solder. In embodiments, an adhesive may be substantially thin to maximize thermal energy transfer. In embodiments, an adhesive may include an epoxy. As illustrated in one aspect of embodiments in FIG. 11, thermal member 130 may be attached to inner conductors 110 through a post by adhesive 140. In embodiments, an adhesive may harden to become a portion on one or more inner conductors, posts and/or outer conductors.

According to embodiments, a thermal member may be a post. In embodiments, a thermal member may be connected to an external heat sink. In embodiments, an external heat sink may be any sink which may transfer thermal energy away from a thermal member. In embodiments, for example, an external heat sink may include active and/or passive devices and/or materials, for example the convection of air, fluid low, metal studs, thermoelectric cooling, and the like.

Embodiments relate to a transmission line structure. In embodiments, a transmission line structure may include one or more outer conductors, one or more inner conductors, and/or one or more thermal managers in accordance with aspects of embodiments. In embodiments, the geometry of one or more inner conductors, one or more outer conductors and/or one or more thermal managers may vary and/or may be configured to maximize transmission of a signal, for example when a signal has a frequency above approximately 1 GHz. In embodiments, the cross-sectional area of one or more inner conductors may be minimized. In embodiments, for example, an inner conductor may be relatively thinner in the region where a thermal member will attach relative to where it will not attach.

In embodiments, the distance between of one or more inner conductors and/or one or more outer conductors may be maximized. In embodiments, the size of a thermal member may be minimized.

According to embodiments, one or more design parameters may be considered when to manufacture and/or operate a transmission line structure in accordance with embodiments. In embodiments, electrical loss of a transmission line structure from unwanted parasitic reactances may be minimized, for example by modifying the geometry of one or more conductors of a waveguide structure in the region of contact with a thermal member. In embodiments, the geometry of one or more conductors may be different with respect to the geometry at other regions of a waveguide structure. In embodiments, the addition of a thermal manager may locally increase the capacitance of a transmission line. In embodiments, capacitance may be balanced by increasing the local inductance. In embodiments, maximizing the local capacitance may be accomplished by, for example, decreasing the cross-sectional area of one or more conductors and/or increasing the space between conductors. In embodiments, for maximum transmission at frequencies below approximately, 1 GHz a variation in geometry may not be employed. In embodiments, for maximum transmission through a waveguide structure, geometries wherein the dimensions of a post and/or attachment geometry to a thermal member are less than approximately 0.1 wavelengths, inductive compensation of thermal members may not be employed.

According to embodiments, a portion and/or substantially an entire transmission line structure may be formed employing any suitable process. In embodiments, a portion and/or substantially an entire transmission line structure may be formed employing, for example, a lamination, pick-and-place, transfer-bonding, deposition and/or electroplating process. Such processes may be illustrated at least at U.S. Pat. Nos. 7,012,489, 7,129,163, 7,649,432, 7,656,256, and/or U.S. patent application Ser. No. 12/953,393, each of which are incorporated by reference herein in their entireties. In embodiments, employing suitable processes may minimize cost, fabrication complexity and/or size while maximizing the thermal energy management of a system.

According to embodiments, for example, a sequential build process including one or more material integration processes may be employed to form one or more transmission line structures. In embodiments, a sequential build process may be accomplished through processes including various combinations of: (a) metal material, sacrificial material (e.g., photoresist), insulative material (e.g., dielectric) and/or thermally conductive material deposition processes; (b) surface planarization; (c) photolithography; and/or (d) etching or other layer removal processes. In embodiments, plating techniques may be useful, although other deposition techniques such as physical vapor deposition (PVD) and/or chemical vapor deposition (CVD) techniques may be employed.

According to embodiments, a sequential build process may include disposing a plurality of layers over a substrate. In embodiments, layers may include one or more layers of a dielectric material, one or more layers of a metal material and/or one or more layers of a resist material. In embodiments, a first microstructural element such as a support member may be formed of dielectric material. In embodiments, a support structure may include an anchoring portion, such as an aperture extending at least partially there-through. In embodiments, a second microstructural element, such as an inner conductor and/or an outer conductor, may be formed of a metal material. In embodiments, one or more layers may be etched by any suitable process, for example wet and/or dry etching processes.

According to embodiments, a metal material may be deposited in an aperture of a first microstructural element, affixing a first microstructural element to a second microstructural element. In embodiments, for example when an anchoring portion includes a re-entrant profile, a first microstructural element may be affixed to a second microstructural element by forming a layer of a second microstructural element on a layer of a first microstructural element. In embodiments, sacrificial material may be removed to form a non-solid volume, which may be occupied by a gas such as air or sulphur hexafluoride, vacuous or a liquid, and/or to which a first microstructural element, second microstructural element and/or thermal member may be exposed. In embodiments, a non-solid volume may be filled with dielectric material, and/or insulative may be disposed between any one of a first microstructural element, a second microstructural element and/or a thermal manager.

According to embodiments, for example, forming a thermal member may be accomplished in a sequential build process by depositing one or more layers of thermally conductive materials. In embodiments, one or more layers of thermally conductive material may be deposited at any desired location, for example at substantially the same in-plane location as a layer of a first microstructural element and/or second microstructural element. In embodiments, one or more layers of thermally conductive material may be deposited at any desired location, for example spaced apart from one or more layers of a first microstructural element and/or second microstructural element.

According to embodiments, for example, any other material integration process may be employed to form a part and/or all of a transmission line structure. In embodiments, for example, transfer bonding, lamination, pick-and-place, deposition transfer (e.g., slurry transfer), and/or electroplating on and/or over a substrate layer, which may be mid build of a process flow, may be employed. In embodiments, a transfer bonding process may include affixing a first material to a carrier substrate, patterning a material, affixing a patterned material to a substrate, and/or releasing a carrier substrate. In embodiments, a lamination process may include patterning a material before and/or after a material is laminated to a substrate layer and/or any other desired layer. In embodiments, a material may be supported by a support lattice to suspend it before it is laminated, and then it may be laminated to a layer. In embodiments, a material may be selectively dispensed. In embodiments, a material may include a layer of a material and/or a portion of a transmission line structure, for example pick-and-placing a thermal manager on a coaxial waveguide structure.

Referring to example FIG. 13, a graph illustrates that minimized electrical transmission loss may be maintained, for example in a transmission line structure that may include a thermal energy manager in accordance with one aspect of embodiments. In embodiments, loss may be minimized by minimizing the dissipated and/or radiated energy, and/or by minimizing the energy reflected back towards the direction from which the energy was incident. According to embodiments, this may be accomplished by changing the dimensions of one or more of the electrical conductors to substantially preserve the characteristic impedance of the transmission line in the region that the thermal jumper is proximate to the transmission line. In embodiments, a device including one or more thermal energy managers may maximize tuning of electrical and/or electromagnetic properties, for example radio frequency structures which may maximize radio frequency signal output.

Various modifications and variations can be made in the embodiments disclosed in addition to those presented. In embodiments, as further non-limiting examples, a transmission line, thermal manager and/or transmission line structure may have any desired geometry, configuration and/or combination of suitable materials. In embodiments, for example, a waveguide structure may be meandered, a thermal member may be etched and/or otherwise manufactured to fit into corresponding areas of a transmission line. In embodiments, for example, a thermal cap may be formed to maximize dissipation of thermal energy traversing the thermal member. In embodiments, a thermal cap may include increased surface area to maximize dissipation of heat flowing through the thermal member, for example in a finned configuration.

The exemplary embodiments described herein in the context of a coaxial transmission line for electromagnetic energy may find application, for example, in the telecommunications industry in radar systems and/or in microwave and millimeter-wave devices. In embodiments, however, exemplary structures and/or processes may be used in numerous fields for microdevices such as in pressure sensors, rollover sensors; mass spectrometers, filters, microfluidic devices, surgical instruments, blood pressure sensors, air flow sensors, hearing aid sensors, image stabilizers, altitude sensors, and autofocus sensors.

Therefore, it will be obvious and apparent to those skilled in the art that various modifications and variations can be made in the embodiments disclosed. Thus, it is intended that the disclosed embodiments cover the obvious and apparent modifications and variations, provided that they are within the scope of the appended claims and their equivalents.

What is claimed is:

1. A transmission line structure comprising:

a. an outer conductor;

b. at least one inner conductor; and c. at least one thermal manager comprising a thermal member, said thermal member configured to form a thermal path away from at least one of said at least one inner conductor, at least part of said thermal member formed of an electrically insulative and thermally conductive material, at least one of said at least one inner conductor being spaced apart from said outer conductor, wherein said thermal member includes a thermal cap which is at least partially accessible from outside said transmission line.

2. The transmission line structure of claim 1, wherein the transmission line structure is manufactured through at least one of a multi-layer build process, a lamination process, a pick-and-place process, a deposition process, an electroplating process and a transfer-binding process, and a combination thereof.

3. The transmission line structure of claim 1, wherein the geometry of at least one of said inner conductor, outer conductor and thermal manager is configured to maximize transmission of a signal.

4. The transmission line structure of claim 3, comprising at least one of:

a. minimizing the cross-sectional area of said inner conductor;

b. maximizing the distance between said inner conductor and said outer conductor; and c. minimizing the size of said thermal member.

5. The transmission line structure thermal manager of claim 4, wherein the signal has a frequency above of approximately 1 GHz.

6. The transmission line structure of claim 1, wherein said thermal cap is disposed at least partially outside said transmission line.

7. The transmission line structure of claim 1, wherein said thermal cap is configured to thermally contact at least one of said at least one inner conductor through a post.

8. The transmission line structure of claim 7, wherein said post is formed of an electrically insulative and thermally conductive material.

9. The transmission line structure of claim 7, wherein said post is configured to pass at least partially through an opening disposed in said outer conductor.

10. A transmission line structure comprising:

a. an outer conductor;

b. at least one inner conductor; and c. at least one thermal manager comprising a thermal member, said thermal member configured to form a thermal path away from at least one of said at least one inner conductor, at least part of said thermal member formed of an electrically insulative and thermally conductive material, at least one of said at least one inner conductor being spaced apart from said outer conductor, wherein said thermal member includes a thermal substrate proximate to said transmission line, said thermal substrate configured to thermally contact at least one of said at least one inner conductor through a post.

11. A transmission line structure comprising:

a. an outer conductor;

b. at least one inner conductor; and c. at least one thermal manager comprising a thermal member, said thermal member configured to form a thermal path away from at least one of said at least one inner conductor, at least part of said thermal member formed of an electrically insulative and thermally conductive material, at least one of said at least one inner conductor being spaced apart from said outer conductor, wherein said thermal member is connected to an external heat sink.

12. The transmission line structure of any one of claims 1, 10, and 11, wherein said thermally conductive and electrically insulative material comprises at least one of:

a. ceramic;
b. aluminum oxide;
c. aluminum nitride;
e. beryllium oxide;
f. silicon carbide;
g. sapphire;
h. quartz;
i. PTFE;
j. diamond (synthetic/natural); and
k. combinations thereof.

13. The transmission line structure of any one of claims 1, 10, and 11, wherein the transmission line structure comprises a waveguide structure including said at least one inner conductor surrounded by said outer conductor on at least three sides.

14. The transmission line structure of claim 13, wherein said waveguide structure is a coaxial waveguide structure.

15. The transmission line structure of any one of claims 1, 10, and 11, wherein said thermal member is attached by an adhesive to at least one of:

a. said at least one inner conductor; and
b. said outer conductor.

16. The transmission line structure of any one of claims 1, 10, and 11, wherein at least one of said at least one inner conductor is spaced apart from said outer conductor by an insulative material.

17. The transmission line structure of any one of claims 1, 10, and 11, wherein said thermal member is a post.

18. The transmission line structure of any one of claims 1, 10, and 11, wherein at least one of said inner conductor and outer conductor is a signal conductor.

19. The transmission line structure of any one of claims 1, 10, and 11, wherein said outer conductor is at least one sidewall of a waveguide structure.

20. The transmission line structure of claim 19, wherein said sidewall is a ground plane.

* * * * *